US005893219A

United States Patent [19]

Smith et al.

[11] Patent Number: 5,893,219

[45] Date of Patent: *Apr. 13, 1999

[54] ARTICLE OF FOOTWEAR

[75] Inventors: Steven F. Smith, Taunton; Peter M. Foley, Needham; Spencer White, N. Easton, all of Mass.

[73] Assignee: Reebok International Ltd., Stoughton, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/906,970

[22] Filed: Aug. 6, 1997

Related U.S. Application Data

[63] Continuation of application No. 08/485,879, Jun. 7, 1995, abandoned, which is a continuation-in-part of application No. 08/168,002, Jan. 2, 1992, abandoned, which is a continuation of application No. 07/646,456, Jan. 25, 1991, abandoned, which is a continuation of application No. 07/307,459, Feb. 8, 1989, abandoned.

[51] Int. Cl.[6] ..... A43B 7/06; A43B 13/20

[52] U.S. Cl. ..... 36/3 B; 36/29; 36/3 R

[58] Field of Search ..... 36/28, 29, 3 R, 36/3 A, 3 D

[56] References Cited

U.S. PATENT DOCUMENTS

| | | | |
|---|---|---|---|
| 508,034 | 11/1893 | Moore . | |
| 2,600,239 | 6/1952 | Gilbert | 36/71 |
| 2,638,690 | 5/1953 | Bullard | 36/71 |
| 3,027,659 | 4/1962 | Gianola | 36/3 R |
| 3,180,039 | 4/1965 | Burns, Jr. | 36/29 |
| 3,410,004 | 11/1968 | Finn | 36/119 |
| 3,685,176 | 8/1972 | Rudy . | |
| 3,738,024 | 6/1973 | Matsuda | 36/119 |
| 3,744,159 | 7/1973 | Nishimura | 36/119 |
| 3,973,336 | 8/1976 | Ahn | 36/3 B |

(List continued on next page.)

FOREIGN PATENT DOCUMENTS

| | | | |
|---|---|---|---|
| 1143938 | 4/1983 | Canada . | |
| 1230225 | 12/1987 | Canada . | |
| 0 630 592 A1 | 12/1994 | European Pat. Off. . | |
| 1204093 | 1/1960 | France . | |
| 2026062 | 9/1970 | France . | |
| 2356384 | 1/1978 | France . | |
| 917173 | 11/1952 | Germany . | |
| 917 173 | 1/1954 | Germany . | |
| 2005365 | 9/1970 | Germany . | |
| 2308547 | 8/1974 | Germany . | |
| 2365329 | 9/1974 | Germany . | |
| 2456612 | 6/1975 | Germany . | |
| 88 02 338 U | 7/1989 | Germany . | |
| 26637 | 7/1897 | United Kingdom . | |
| 2039717 | 8/1980 | United Kingdom . | |
| 2 114 425 | 8/1983 | United Kingdom . | |
| 2165439 | 4/1986 | United Kingdom | 36/3 B |
| 2240254 | 7/1991 | United Kingdom | 36/3 B |
| 2271710 | 4/1994 | United Kingdom | 36/3 B |
| WO87/03789 | 7/1987 | WIPO . | |
| WO90/04323 | 5/1990 | WIPO . | |

OTHER PUBLICATIONS

ZONIC Product Description, date unknown.

*Primary Examiner*—M. D. Patterson

*Attorney, Agent, or Firm*—Sterne, Kessler, Goldstein & Fox P.L.L.C.

[57] ABSTRACT

The present invention is directed to an article of footwear including an upper, a sole and a pumping chamber for producing a continuous supply of fluid. The sole includes a midsole and an outsole. The pumping chamber is formed between the bottom surface of the midsole and the upper surface of the outsole and includes at least one inlet and at least one outlet. Movement of the wearer's foot causes fluid to be drawn into and expelled from the pumping chamber. The fluid produced by the pumping chamber may be used to inflate an expandable bladder or to provide ventilation to the wearer's foot.

20 Claims, 19 Drawing Sheets

U.S. PATENT DOCUMENTS

| | | | |
|---|---|---|---|
| 4,178,013 | 12/1979 | Bataille | 280/611 |
| 4,232,459 | 11/1980 | Vaccari | 36/71 |
| 4,236,725 | 12/1980 | Bataille | 280/611 |
| 4,372,297 | 2/1983 | Perlin | 128/64 |
| 4,397,104 | 8/1983 | Doak | 36/29 |
| 4,417,407 | 11/1983 | Fukuoka | 36/3 B |
| 4,446,634 | 5/1984 | Johnson et al. | 36/29 |
| 4,462,171 | 7/1984 | Whispell | 36/3 B |
| 4,583,305 | 4/1986 | Miyamoto | 36/119 |
| 4,631,843 | 12/1986 | Annovi | 36/119 |
| 4,662,087 | 5/1987 | Beuch | 36/88 |
| 4,702,022 | 10/1987 | Porcher | 36/119 |
| 4,712,316 | 12/1987 | Baggio | 36/119 |
| 4,730,403 | 3/1988 | Walkhoff | 36/119 |
| 4,760,651 | 8/1988 | Pon-Tzu | 36/3 B |
| 4,763,426 | 8/1988 | Polus et al. | 36/29 |
| 4,776,110 | 10/1988 | Shiang | 36/3 B |
| 4,823,482 | 4/1989 | Lakic | 36/119 |
| 4,912,861 | 4/1990 | Huang . | |
| 4,991,317 | 2/1991 | Lakic . | |
| 4,995,124 | 2/1991 | Wridge, Jr. et al. . | |
| 4,995,173 | 2/1991 | Spier . | |
| 4,999,932 | 3/1991 | Grim | 36/29 |
| 5,010,661 | 4/1991 | Chu | 36/3 R |
| 5,195,254 | 3/1993 | Tyng | 36/3 B |
| 5,230,249 | 7/1993 | Sasaki et al. . | |
| 5,295,313 | 3/1994 | Lee | 36/3 B |
| 5,353,525 | 10/1994 | Grim | 36/29 |
| 5,375,345 | 12/1994 | Djuric | 36/3 B |
| 5,400,526 | 3/1995 | Sessa | 36/3 B |
| 5,408,760 | 4/1995 | Tse et al. | 36/3 B |

ARTICLE OF FOOTWEAR

CROSS-REFERENCE TO RELATED APPLICATIONS

This application is a continuation of application Ser. No. 08/485,879, filed Jun. 7, 1995, now abandoned, which is a continuation-in-part of application Ser. No. 08/168,002, filed Jan. 2, 1992, now abandoned, which is a continuation of application Ser. No. 07/646,456, filed Jan. 25, 1991, abandoned, which is continuation of application Ser. No. 07/307,459, filed Feb. 8, 1989, abandoned.

BACKGROUND OF THE INVENTION

1. Field of the Invention

This invention relates to an article of footwear, and more particularly to an athletic shoe having a self-pumping chamber for producing a continuous supply of fluid. The fluid produced by the chamber may be used to provide ventilation to the foot of the wearer or to improve the fit or cushioning aspects of the shoe.

2. Related Art

Articles of footwear, including athletic shoes, typically include a flexible upper and a sole. Such articles of footwear are sold in a variety of sizes according to the length and width of the wearer's foot. However, even feet of similar length and width do not necessarily have the same configuration. Therefore, the upper may be adjustable to accommodate various configurations of the human foot. Such adjustment may include medial and lateral side portions which, when tensioned, provide support to the foot. In addition, particularly in the case of athletic footwear, the upper may include an ankle portion which encompasses a portion of the ankle region of the foot and thereby provides support thereto.

The support provided by the upper may be enhanced by the provision of an adjustable fastening system on the upper, which allows the wearer to adjust the tension of the upper on the foot. One common example of a fastening system includes an eyestay opening which overlies the instep portion of the foot. A tongue piece may be provided on the upper beneath the eyestay opening. An eyestay piece is attached to the upper at the eyestay opening. The eyestay piece may include eyelets or other type apertures which allow, for example, a shoe lace, or a strap, to be fed therethrough. By altering the tension on the shoe lace or strap, the distance between the opposing edges of the eyestay opening is varied. Hence, the fit of the shoe in general, can be altered by adjusting the fastening system.

While such fastening systems are common, they do suffer from several disadvantages, for example, when the shoe lace or strap is drawn too tightly, the fastening system puts pressure on the instep of the foot. Such localized pressure is uncomfortable to the wearer and can make it difficult for the shoe to be worn for prolonged periods of time. Furthermore, while such fastening systems allow the upper of the shoe to be adjustable to accommodate varying foot and ankle configurations, they do not necessarily mold to the contour of individual feet and thereby provide additional support for the foot. Moreover, no matter how much tension is exerted on the medial and lateral side portion, there still remain areas of the foot which are not supported by the upper, due to the irregular contour of the foot.

Heretofore, various devices have been proposed for adjusting the fastening force of an upper on the foot. Many provide an inflatable bladder within the interior of the footwear. One example is U.S. Pat. No. 4,583,305 to Miyamoto which provides an inflatable air pack within the interior of a ski boot. The air pack overlies the instep of the foot and is inflated by an electronic pump affixed to the rear ankle portion of the boot. The wearer may select a desired air pressure for the interior of the air pack. The electronic pump has a sensor which causes a pump motor to stop sending air to the pack when the pressure within the air pack has reached the desired pressure. The air pack may be deflated by a electronic switch.

The Miyamoto device suffers from disadvantages which are overcome by the present invention. For example, the device does not provide for diffusion of air from within the pack. Therefore, when the air pressure within the air pack decreases due to diffusion, the Miyamoto device provides no means for sensing diffusion and for automatically transferring air to the pack to return it to the preselected pressure. As a result, the air pressure within the pack does not maintain constant.

Similarly, inflatable devices have been proposed to provide firm support and restraining forces against the foot, while conforming to the irregular contour of the foot. One example is U.S. Pat. No. 3,685,176 to Rudy. This patent discloses a gas-inflatable bladder also disposed within a ski boot, which when inflated, exerts force on the instep, achilles heel and ankle of the foot to maintain the same in proper position within the boot.

The Rudy bladder has disadvantages of its own which are overcome by the present invention. First, the Rudy bladder includes no means for adjusting the fluid pressure once the bladder has been inflated. Second, the Rudy bladder is inflated using a pressurized gas which is more costly than simply using ambient air. Furthermore, the Rudy bladder does not provide for diffusion, i.e. no means is provided for automatically re-inflating the bladder upon such diffusion.

Therefore, the need exists for an article of footwear which provides firm, comfortable support to the foot while also conforming to the foot's irregular contour. Furthermore, the need exists for an article of footwear which provides an inflatable bladder which allows the fluid pressure within to be preselected and which maintains that preselected pressure by continually transferring air from the atmosphere thereto.

Still other articles of footwear having an inflatable bladder to improve the fit of the upper utilize a pumping mechanism which is activated by movement of the upper portion of the wearer's foot. One such article of footwear is disclosed in U.S. Pat. No. 4,178,013 to Bataille. Although the pumping mechanism of the Bataille patent is capable of supplying fluid to an inflatable bladder, the device of the Bataille patent suffers from a major disadvantage. As the inflatable bladder of the Bataille patent reaches a highly pressurized state, the upper portion of the wearer's foot is incapable of movement necessary to activate the pumping mechanism. Thus, the supply of air to the bladder is interrupted as the pressure within the bladder increases.

In an effort to move away from pumping mechanisms dependent upon movement of the upper portion of the wearer's foot, pumping chambers disposed within the sole of the shoe have been developed. An example of such a shoe is disclosed in International Publication No. WO 87/03789 to Johnson. The Johnson publication discloses an athletic shoe having a pumping cavity in the sole of the shoe. The pumping cavity of the Johnson publication includes at least one inlet for drawing air into the pumping cavity and at least one outlet for expelling air from the pumping cavity. The shoe of the Johnson publication suffers, however, from the fact that the inlet and outlet of the pumping cavity are exposed to the atmosphere exterior of the shoe. Thus, as the wearer moves, dirt and other particulate matter is capable of entering the inlet and outlet of the pumping cavity to interfere with operation of the same. In addition to the foregoing disadvantage, the shoe of the Johnson publication does not include a pumping cavity in the forefoot portion of the shoe. Thus, if the wearer fails to land on or strike the heel of the shoe, no pumping action is produced.

Yet another device having a pumping mechanism in the sole of the shoe is disclosed in U.S. Pat. No. 4,763,426 to Polus et al. The Polus patent discloses a shoe having a midsole and an outsole. A chamber body is disposed within the interior of the midsole to provide cushioning to the foot of the wearer. Although the chamber body of the Polus patent is capable of providing air to a cushioning device of the sole, the Polus device includes many component parts which must be separately assembled into the shoe and are expensive to manufacture.

Thus, there is a need for an athletic shoe having a pumping mechanism which continuously produces a supply of fluid, such as air, for inflating an inflatable support system, for pressurizing a pneumatic cushioning device, or for any other purpose requiring a continuous supply of fluid. There is another need for a pumping mechanism having an inlet and an outlet which is not open to the atmosphere. There is yet another need for an athletic shoe having a pumping mechanism in the forefoot and heel regions of the shoe. There is still another need for a pumping mechanism which is inexpensive to manufacture and includes few component parts. Finally, it is desirable to provide a self-pumping mechanism in a shoe that is completely independent of the user for producing a continuous supply of fluid such as air.

SUMMARY OF THE INVENTION

It was with the foregoing needs and objectives in mind that the present invention was developed. The present invention relates generally to an athletic shoe or other article of footwear having a pumping chamber or chambers for producing a continuous supply of fluid. In one aspect of the invention, the article of footwear comprises an upper and a sole. The sole comprises a midsole and an outsole which are joined to form a chamber for receiving fluid. An inlet, in fluid communication with the chamber and open to the interior of the article of footwear, is disposed at a first position in the midsole. An inlet check valve is disposed within the inlet and permits the flow of fluid into the chamber. An outlet, also in fluid communication with the chamber and open to the interior of the article of footwear, is disposed at a second position in the midsole. An outlet check valve is disposed within the outlet and permits the flow of fluid out of the chamber. Movement of the foot of the wearer causes fluid to be continuously drawn into the chamber through the inlet and expelled from the chamber through the outlet.

The article of footwear may also include a bladder which is in fluid communication with the outlet of the chamber. The outlet of the chamber may be positioned interior of the article of footwear to provide ventilation to the wearer's foot. The outsole may include a first concavity which defines a forefoot chamber and a second concavity which defines a heel chamber. A cushioning material may be used to form the midsole. The outsole may be formed from an abrasive resistant material.

In another aspect of the invention, the article of footwear is an athletic shoe comprising an upper, a sole and a pump located in the sole. The pump comprises an inlet disposed interior of the shoe and an outlet disposed interior of the shoe. The inlet comprises a first check valve for permitting the flow of fluid into the pump. The outlet comprises a second check valve for enabling the flow of fluid out the pump. Fluid is continuously drawn into and expelled from the pump by a force applied to the sole.

The sole may comprise a midsole formed from a cushioning material and an outsole formed from an abrasive resistant material. The midsole may be provided with a recess which is disposed in a facing relationship with a concavity of the outsole to form the pump. The athletic shoe may further comprise a bladder in fluid communication with the outlet of the pump. The bladder may be located in the upper of the shoe. A valve for enabling the release of fluid from the bladder may also be provided.

In yet another aspect of the invention, a sole for producing a continuous supply of the fluid is provided. The sole comprises a midsole and an outsole which together define a forefoot pumping chamber and a heel pumping chamber. A first inlet, extending through the top surface of the midsole, is disposed in fluid communication with the forefoot pumping chamber. A second inlet, extending through the top surface of the midsole, is disposed in fluid communication with the heel pumping chamber. A first inlet check valve is disposed in the first inlet to permit the flow of fluid into the forefoot pumping chamber. A second inlet check valve is disposed in the second inlet to permit the flow of fluid into the heel pumping chamber. A first outlet, extending through the top surface of the midsole, is disposed in fluid communication with the forefoot pumping chamber. A second outlet, extending through the top surface of the midsole, is disposed in fluid communication with the heel pumping chamber. A first outlet check valve, disposed in the first outlet, permits the flow of fluid out of the forefoot pumping chamber. A second outlet check valve, disposed in the second outlet, permits the flow of fluid out of the heel pumping chamber. Fluid flows into the forefoot and heel pumping chambers through the first and second inlets, respectively, and out of the forefoot and heel pumping chambers through the first and second outlets, respectively, to provide a continuous supply of fluid in response to the gait of the wearer.

The first and second inlet check valves may comprise a latex ball contained within a cylindrical housing. The first and second outlet check valves may comprise a molded elastomeric tube having a duck-billed exit opening. The forefoot concavity may be 3.5 mm deep. The heel concavity may be 5.5 mm deep. The midsole may be formed from a cushioning material. The outsole may be formed from an abrasive resistant material.

BRIEF DESCRIPTION OF THE FIGURES

The foregoing and other objects, aspects, features and advantages of the present invention will be more fully appreciated as the same become better understood from the following detailed description of the present invention when considered in conjunction with the accompanying drawings, in which.

DETAILED DESCRIPTION OF THE PREFERRED EMBODIMENTS

Figure 1:
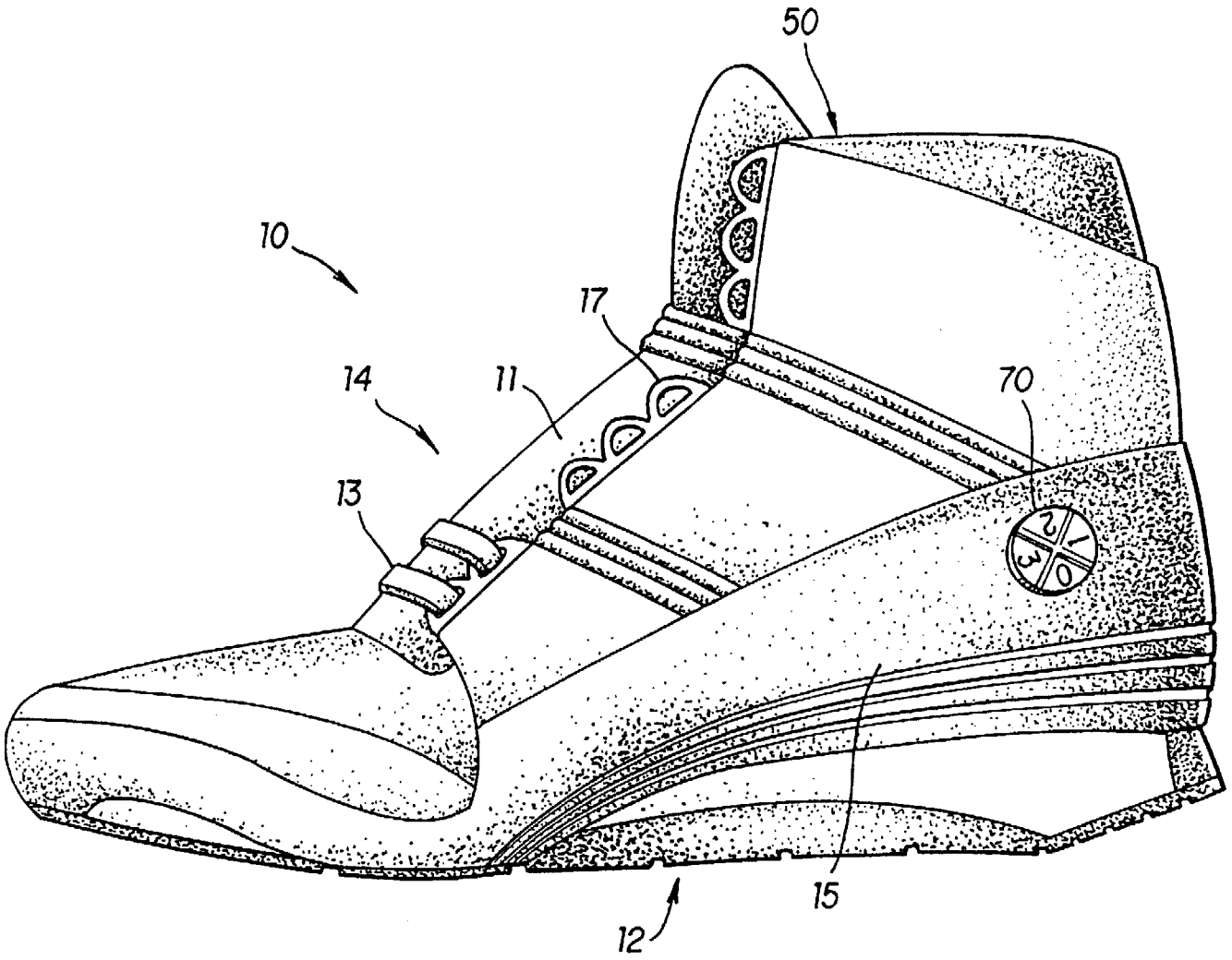
FIG. 1 shows a side elevational view of an article of footwear according to the present invention.

Referring now to the drawings, in which similar reference numerals have been used to refer to similar elements, and in particular to FIG. 1, a shoe is shown generally at 10. Shoe 10 incorporates the support system of the present invention. The support system, which will be discussed in detail below, allows a wearer to preselect the pressure.

A variety of shoe structures are capable of incorporating the present invention. However, it is preferred that shoe 10 include a sole, shown generally at 12, and an upper, shown generally at 14. Upper 14 may be attached to sole 12 by any known methods. FIG. 1 shows a shoe for the left foot. A shoe incorporating the principles of the present invention for the right foot would be a mirror image of FIG. 1. Shoe 10 may include a heel stabilizer 15, a tongue 11, shoe lace 13 and an eyestay 17. A conventional sock liner may be disposed within upper 14. Rather than shoe laces 13, shoe 10 may include strap-type fasteners which are secured, for example, by a buckle or by hook and loop type fasteners. Additionally, rather than having the foot entry at the front or instep portion of upper 14 as shown, shoe 10 could include a rear foot entry or side foot entry. A relief valve 70, which will be discussed in detail below, is also shown in FIG. 1. While relief valve 70 is shown in the heel region of upper 14, relief valve 70 could be placed anywhere on upper 14, provided it did not interfere with the function of the other elements which make up upper 14.

Figure 2:
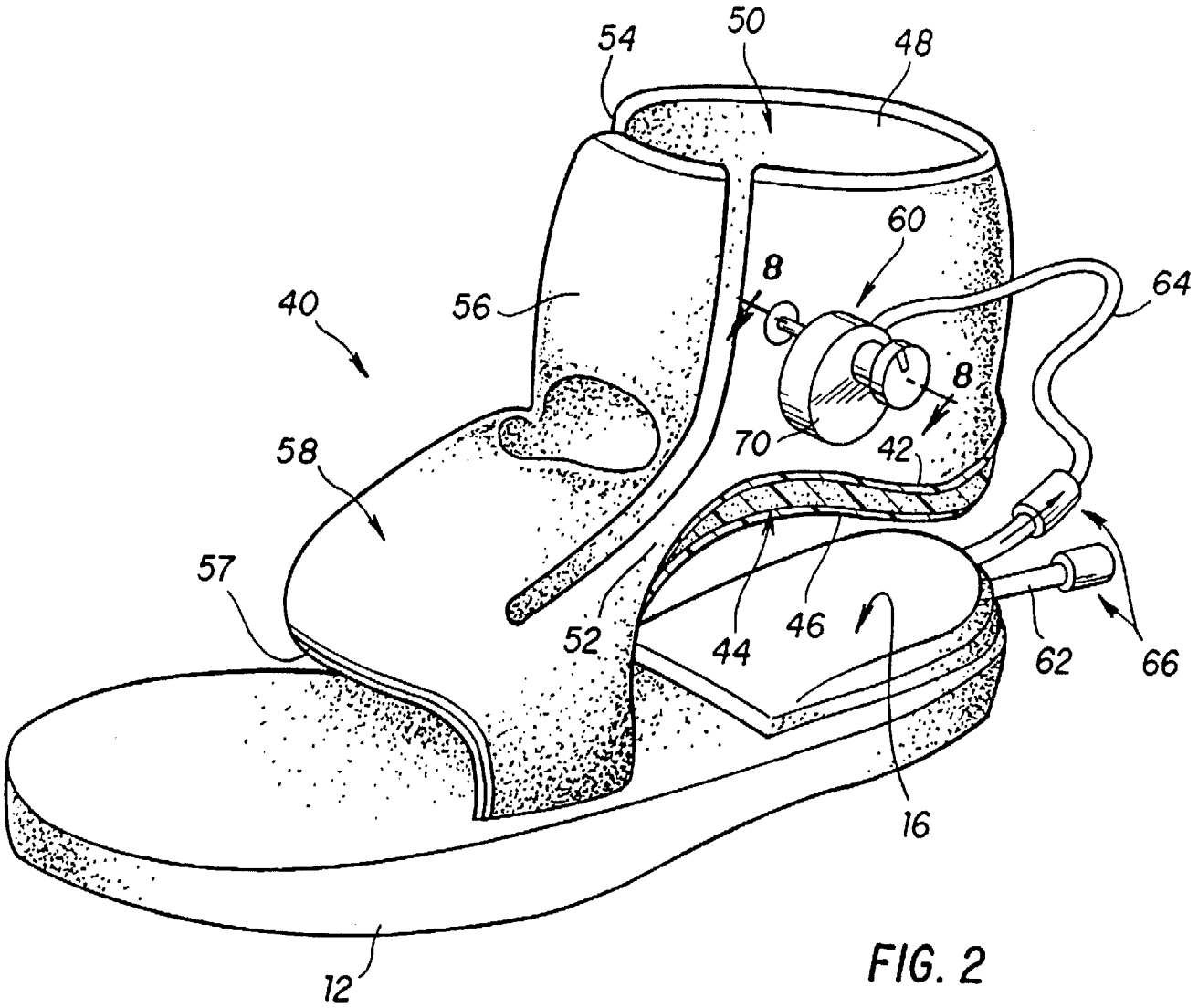
FIG. 2 shows a support system for the article of footwear of FIG. 1.

FIG. 2 shows the support system of the present invention. The support system comprises a pump 16, in fluid communication with an inflatable bladder, shown generally at 40, the fluid pressure of which may be preselected by a regulator, shown generally at 60. The fluid within bladder 40 is constantly regenerated by the fluid transferred thereto by pump 16. Furthermore, fluid which exits bladder 40, e.g., by diffusion, is replaced automatically by pump 16. Hence, the fluid which enters bladder 40 is equal to fluid which exits bladder 40. Therefore, the preselected fluid pressure of bladder 40 is maintained constant. Each of the components will be described in turn, in greater detail below.

Pump 16 is comprised of a top layer 18 and a bottom layer 22, both of which are made from any suitable material, for example, a urethane film. One example of a urethane film which is applicable in the present invention is available from J. P. Stevens & Co., Inc., Northampton, Mass., as product designation MP1880. Disposed between top layer 18 and bottom layer 22 is a foam layer 20. The function of foam layer 20 is to add resiliency to pump 16 and to provide cushioning to the underneath of the heel of the foot. Foam layer 20 may be comprised of any suitable porous material which is capable of allowing fluid to pass therethrough. One example of a suitable material is a polyurethane open-cell foam having 10 to 55 PPI (pores per inch). Such as material is available from United Foam Plastics of Georgetown, Mass. In the alternative, a molded component in a non-compressed state could be substituted for the above-described pump, as could other known pump constructions which would be compatible with the present design.

Top layer 18, foam layer 20 and bottom layer 22 are all of similar dimension and are attached at their edges 24 to form pump 16. One example of a suitable attachment means includes the application of high radio frequency to edges 24 which causes layers 18, 20 and 22 to adhere to one another. However, other methods of attachment are possible.

Figure 4:
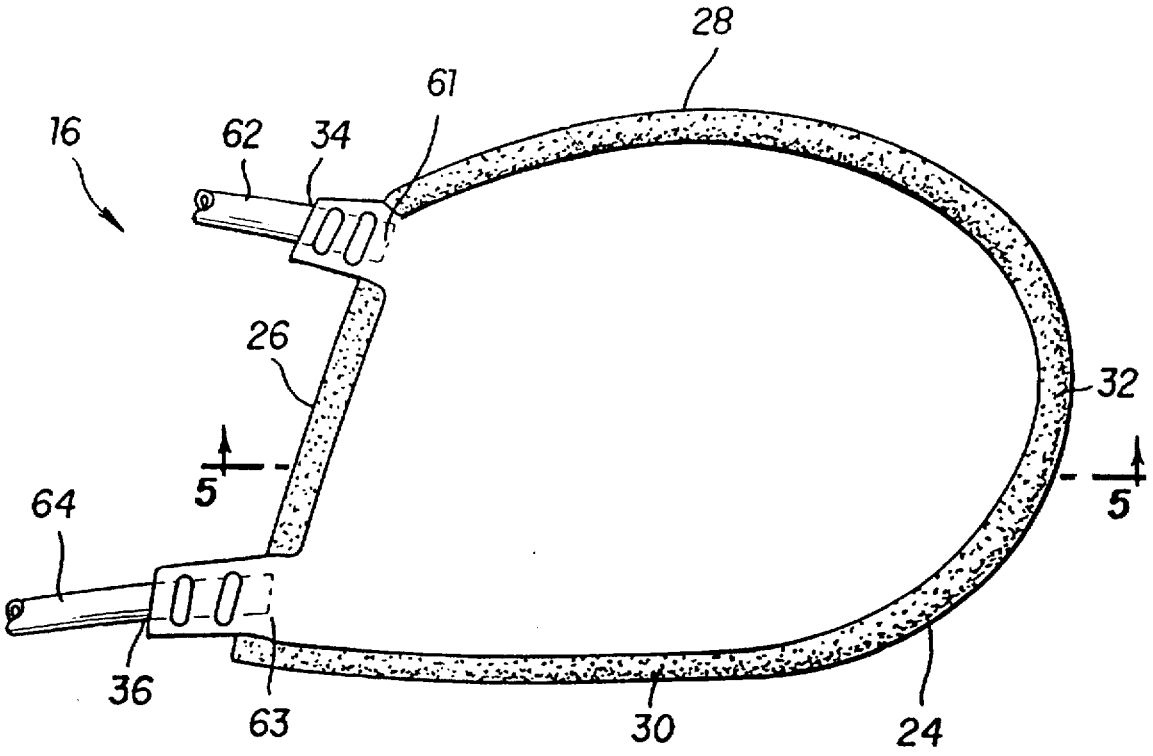
FIG. 4 shows a top plan view of a pump used in the support system of the present invention.
Figure 5:
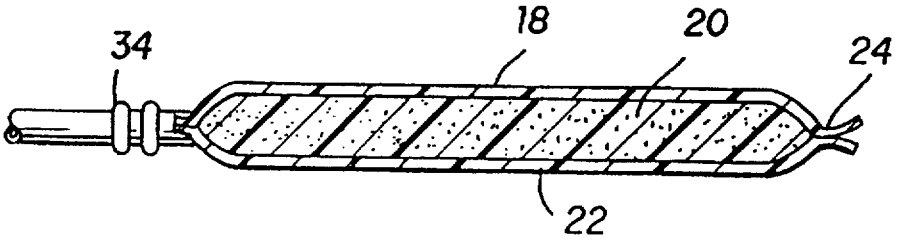
FIG. 5 shows a cross-sectional view taken along line 5—5 of FIG. 4.

Referring now more specifically to FIGS. 4 and 5, pump 16 comprises a heel end 26, a medial side 28, a lateral side 30, and a forward end 32. A fluid inlet port 34 and a fluid outlet port 46 are disposed at heel end 26 of pump 16. However, fluid inlet port 34 and/or fluid outlet port 36 could be disposed at medial side 28, lateral side 30 or forward end 32 of pump 16 if so desired. Neither is it necessary for inlet port 34 and outlet port 46 to be disposed along the same side of pump 16. Furthermore, although the particular configuration of pump 16 has been shown, alternate pump structures could be used with the present invention, for example, a pump made of materials other than those described above may be suited to the present invention.

In a preferred form, the length of pump 16, from forward end 32 to heel end 26, is approximately 3.0". A preferred width of pump 16, from medial side 28 to lateral side 30, is approximately 2.25". However, it should be understood that these dimensions will vary depending upon the size of the footwear in which the pump is used and upon the placement of the pump within the shoe.

With continuing reference to FIG. 2, bladder 40 is shown. Bladder 40 may be affixed to upper 14 of shoe 10, it may be affixed to sole 12, or it may be affixed to both upper 14 and sole 12. If affixation is required, it may be accomplished by any known methods, for example stitching and adhesive bonding. It is preferred that bladder 40 encompass at least a portion of the foot of a wearer, and more particularly, encompass at least a portion of the instep and ankle regions of the foot.

While bladder 40 is not shown in the drawings to be compartmented, individual compartments or fluid receiving chambers could be provided in various areas of bladder 40. One example would be to heat-seal seams along bladder 40. Such seams could also be perforated to allow ventilation to the foot. Such compartments may be interconnected or may be individually inflated by pump 16 or by several pumps.

Bladder 40 is similar in construction to pump 16. That is, bladder 40 is comprised of an interior layer 42 and an exterior layer 46. Both interior layer 42 and exterior layer 46 are comprised of a suitable material, for example, a urethane film such as the one described above with regard to top layer 18 and bottom layer 22 of pump 16. A foam layer 44 may be disposed between interior layer 42 and exterior layer. Foam layer 44 may be comprised of any suitable resilient material capable of allowing fluid to pass therethrough. One example is an open-cell foam such as the one described above with regard to foam layer 20 of pump 16. Alternatively, foam layer 44 may be eliminated.

Interior layer 42, foam layer 44 and exterior layer 46 are attached at their edges to form bladder 40. Such attachment may be by any known method, for example, by high radio frequency which welds the layers together, as described above with regard to pump 16. Exterior layer 46 may have a brushed or napped surface facing the foot for improved comfort. Alternatively, a foot compatible liner may be affixed to the foot contacting surface of exterior layer 46.

Continuing with FIG. 2, bladder 40 includes a foot opening 50, through which the foot of a wearer is inserted. Bladder 40 also includes a medial side portion 52, a lateral side portion 54, an instep portion 56, which underlies the tongue 11 of shoe 10, and a forefoot portion 58. Forefoot portion 58 connects medial side portion 52 and lateral side portion 54 with instep portion 56. As shown in FIG. 2, forward end 57 of bladder 40 terminates at a point short of the toe receiving end of sole 12. Alternatively, forward end 57 could extend the full length of sole 12, thereby covering the toes of a wearer, or forward end 57 could also be positioned at any point between the toe and heel receiving ends of sole 12.

Furthermore, while bladder 40 is shown to terminate where it joins sole 12, bladder 40 could extend along the top surface of sole 12, thereby underlying the foot of a wearer. One example of such a configuration would be to extend bladder 40 under the instep region of the foot to provide support and cushioning to the plantar arch. While the regulator 60 of the present invention will be described in more detail below, in such a modification, it may be desirable to provide an individual regulator for each region of the bladder. For example, one regulator could be provided for the medial side portion 52 and lateral side portion 54 of bladder 40, while a second regulator could be provided for the instep region.

Continuing with FIG. 2, regulator 60 comprises tubing and a relief valve 70, each of which will be described in more detail below.

The tubing which may be utilized with the present invention may be comprised of any suitable flexible, small diameter tubing material which is capable of being affixed to pump 16 and bladder 40. One example of tubing which is suitable for use with the present invention is a 1/16 inch I.D.×1/8 inch O.D. clear polyurethane tubing which is available from Industrial Specialties, Inc., Englewood, Colo.

More specifically, tubing includes pump tube 62 which is affixed at one end 61 to pump 16 at air inlet port 34 (FIG. 4). The other end of pump tube 62 may extend to the exterior of the upper or may terminate within upper 14. This end of pump tube 62 serves as an inlet port for transferring ambient air to pump 16. Fill tube 64 is connected at one end 63 to fluid outlet port 36 of pump 16 (FIG. 4). The other end 71 of fill tube 64 is attached to relief valve 70. Check valves 66 are provided on both pump tube 62 and fill tube 64. Check valves 66 maintain air travel in one preferred direction through the system, by preventing air already within the system from traveling back out of fill tube 64 and pump tube 62. Check valves 66 may be of any known type, provided they are compatible with the particular tubing used. One example of acceptable check valves for use with the present invention is model #2804-401 available from Airlogic, Racine, Wis.

Figure 8:
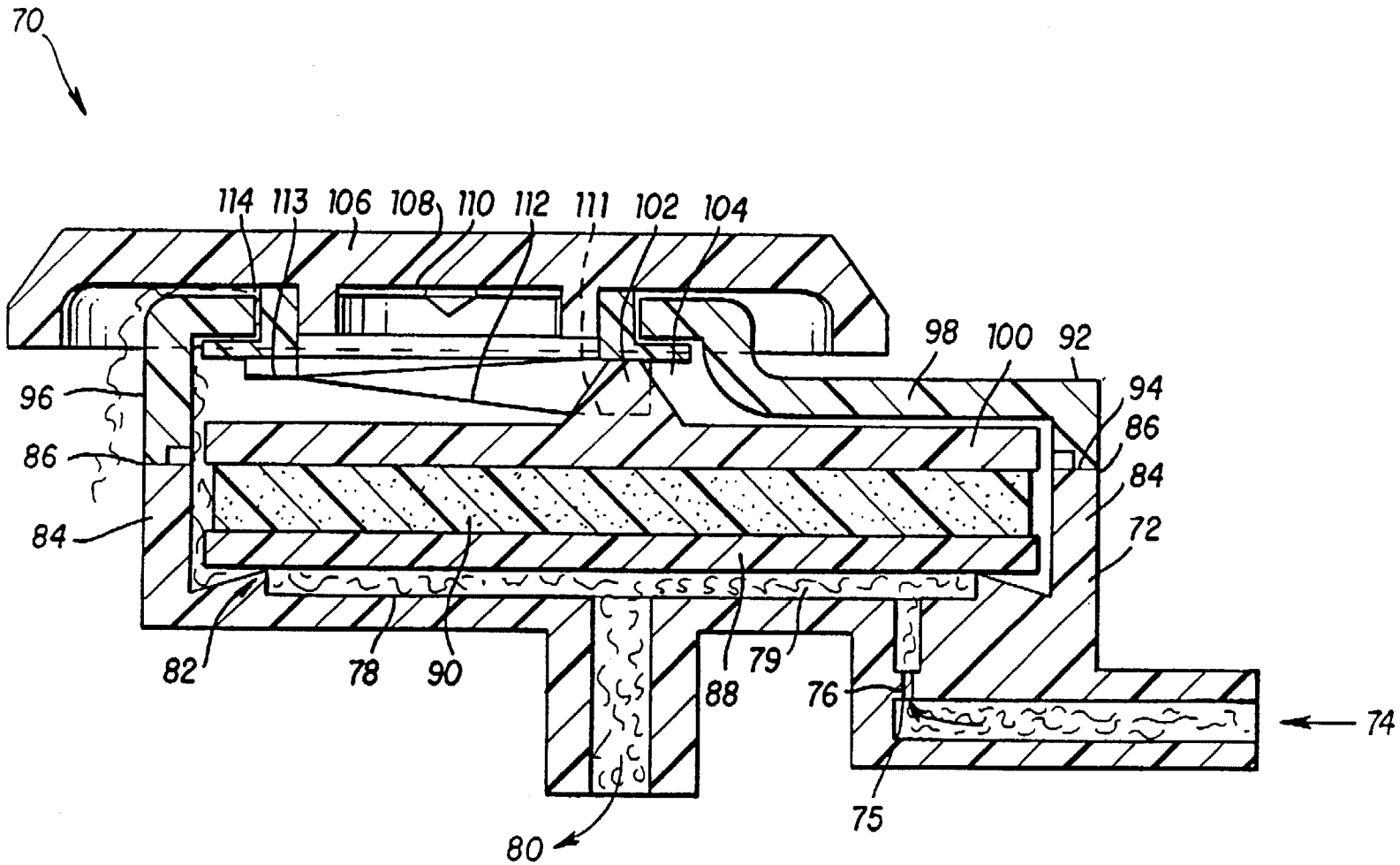
FIG. 8 is a cross-section taken along line 8—8 of FIG. 2.

Referring now to FIG. 8, relief valve 70 will be described in detail. Relief valve 70 comprises a casing which is preferably made of injection molded plastic. Any suitable plastic material may be used. However, it is preferred that a material similar to CYCOLACT-T (ABS), available from General Electric, Pittsfield, Mass. be used. Relief valve 70 comprises a base portion 72, a cover 92 and a cap 106. Base 72 includes a relief valve inlet 74 which is in fluid communication with pump 16 via fill tube 64. Orifice restrictor 76 is provided at one end 75 of relief valve inlet 74. Orifice restrictor 76 is smaller in diameter than relief valve inlet 74 and thereby limits the amount of fluid which may pass from relief valve inlet 74 to the interior 79 of relief valve 70. Therefore, orifice restrictor 76 prevents rapid pressure loss within pump 16 which provides cushioning for the heel of the foot, for example if the wearer jumps and lands squarely on his heel.

Base 72 of relief valve 70 further comprises a bottom 78. A relief valve outlet 80 is provided on bottom 78. Relief valve outlet 80 is in fluid communication with bladder 40. That is, air within the interior 79 of relief valve 70 is allowed to migrate into bladder 40 through relief valve outlet 80.

Annular seat 82 is provided along bottom 78 of relief valve 70. Annular seat 82 is a continuous circumferential ridge which extends away from bottom 78 towards interior 79. A continuous side wall 84 extends toward cover 92 and with base 78, defines interior 79. Side wall 84 has a top periphery 86 which defines a bond line to which cover 92 is joined. Within interior 79 is positioned a valve head 88. Valve head 88 is a disc-like element which rests on annular seat 82. Valve head 88 may be made of injection molded plastic similar to the material comprising the relief valve casing. In addition, valve head 88 may have bonded to it a layer of sheet rubber material 89, which may create a more effective seal between annular seat 82 and valve head 88.

Also disposed within the interior of base 72 is a spring 90. Spring 90 rest on valve head 88 and biases valve head 88 against annular seat 82. Spring 90 may be comprised of any suitable resilient material or mechanical springs, e.g., a Beryllium copper spring available from Instrument Specialties, Corp., Delaware Water Gap, Pa. One example of a suitable resilient material for use with the present invention is a synthetic open-cell foam, similar to the open-cell foam described above with regard to foam layer 44 of bladder 40 and foam layer 20 of pump 16.

Cover 92 of relief valve 70 includes a lower periphery 94 which joins base 72 at top periphery 86. Cover 92 also includes a cylindrical side wall 96 which is compatible in dimension with cylindrical side wall 84 of base 72. While a circular relief valve 70 has been shown in the drawings, relief valve 70 could take a variety of geometric configurations without affecting the function of the relief valve which is to bleed excess air from bladder 40.

Cover 92 further includes a top wall 98 which is connected to side wall 96. Top wall 98 includes a top opening 104 through which a rotatable cap 106 is inserted. Within cover 92 is disposed a plunger 100 which may also be comprised of injection molded plastic material similar to that which comprises the relief valve casing. Plunger 100 rests upon spring 90 disposed within base 72, and is a disc-like structure which includes a protrusion 102.

Rotatable cap 106 includes a top surface 108 which may include indicia for indicating the available pressure settings for relief valve 70. Cap 106 also includes a bottom surface 110. Disposed upon bottom surface 110 is a cam surface 112. Cam surface 112 may be molded to cap 106 or it may be separate therefrom. Cam surface 112 is a circular ramp having a large region 111 and a small region 113.

As cam surface 112 is rotated within cap 92, it engages protrusion 102, and thereby adjusts the position of plunger 100 relative to spring 90 and valve head 88. When the large region 111 is against protrusion 102 of plunger 100, the greatest force from cap 106 is against plunger 100. Spring 90 transfers the force from plunger 100 to valve head 88 which is biased by spring 90 against annular seat 82. In this position, the least amount of air is allowed to pass between valve head 88 and annular seat 82. Furthermore, the greatest amount of air pressure is retained within bladder 40.

Conversely, when the small region of cam surface 112 is against protrusion 102 of plunger 100, the least force from cap 106 is against plunger 100. In this position, the greatest amount of air is allowed to pass between valve head 88 and annular seat 82. Hence, the least amount of air pressure is retained within bladder 40.

A clearance gap 114 is provided between cam surface 112 and top opening 104 of cap 92. Clearance gap 114 allows excess air from within interior 79 to bleed out of relief valve 70 to the atmosphere. While one embodiment of the relief valve 70 has been shown and described, it should be understood that other known relief valve structures may be utilized with the present invention without departing from the principles thereof.

Figure 3:
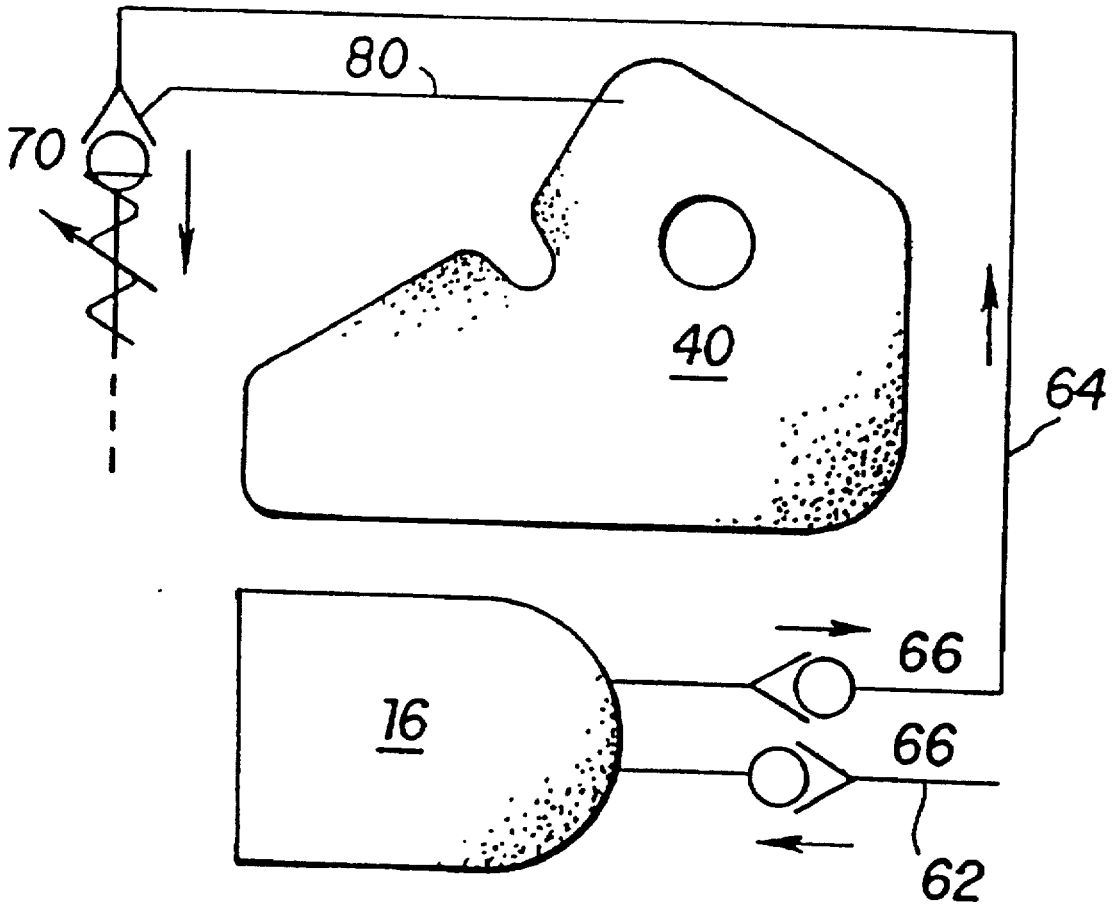
FIG. 3 shows an airflow schematic diagram for the support system of FIG. 1.

The air flow schematic diagram of FIG. 3 shows how air is feed transferred through the support system shown in FIG. 2. Air from the atmosphere enters the system through pump tube 62. Check valve 66 prevents the air from returning to the atmosphere through pump tube 62. When pressure is applied to pump 16, the air within is forced out through fill tube 64 to relief valve 70. A second check valve 66 is provided on fill tube 64 to prevent air from returning to pump 16. Once inside relief valve 70, the air may enter bladder 40. If bladder 40 has reached the preselected interior air pressure, the air from fill tube 64 is instead returned to the atmosphere through clearance gap 114.

Many embodiments incorporating the principals of the present invention are possible. One example, is to incorporate a forefoot ventilating system with the interior support system described above. Such a forefoot ventilating system is shown generally at 119 in FIG. 6. Forefoot ventilating system 119 includes a vent tube 120 and a perforated end 122. Vent tube 120 is connected at one end 121 to relief valve 70 and extends into upper 14. Perforated end 122 of vent tube 120 is shown disposed underneath the forefoot area of the foot within sole 12. Rather than escaping to the atmosphere through clearance gap 114, as in FIG. 2, in this embodiment excess air from relief valve 70 is transferred to the interior of upper 14 via perforated end 122 of vent tube 120. This transfer of air can be an effective means for cooling the foot of a wearer.

Figure 6:
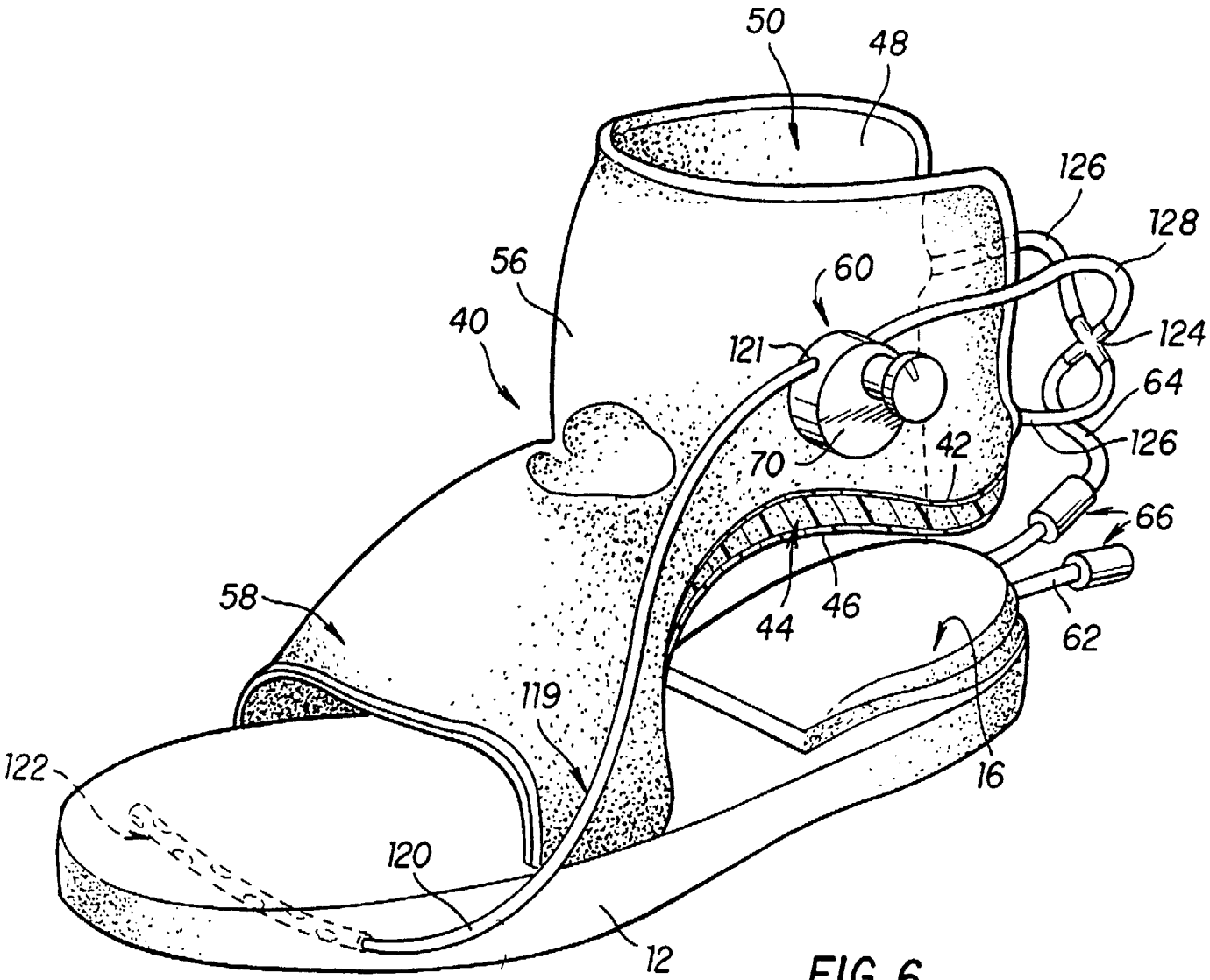
FIG. 6 shows an alternate embodiment of the support system of the present invention.

While FIG. 6 shows perforated end 122 disposed underneath the forefoot area of the foot, perforated end 122 could be located anywhere along sole 12 or affixed to upper 14 and extend above the foot. Furthermore, rather than perforating vent tube 120 to create perforated end 122, a perforated element could be coupled to vent tube 120. In addition, the portion of sole 12 above perforated end 122 may be modified so that air is allowed to more easily pass through sole 12. For example, a less dense material could be used in that portion of the sole.

With continuing reference to FIG. 6, an alternate embodiment of regulator 60 is shown. In this embodiment, fill tube 64 from pump 16 is connected to an X-shaped connector 124. Two bladder tubes 126 and a regulator tube 128 are also attached to connector 124. As in the previous embodiment, air enters the system through pump tube 62 and is transferred to pump 16. Check valve 66 disposed on pump tube 62 prevents air from exiting through pump tube 62. When pump 16 is compressed, the air is forced out of pump 16 through fill tube 64 to connector 124. From connector 124 the air is transferred to bladder 40 through bladder tubes 126. Once the preselected air pressure within bladder 40 has been attained, excess air from bladder 40 is transferred back through bladder tubes 126 to connector 124. From connector 124, the excess air is transferred through regulator tube 128 to relief valve 70. Check valve 66 disposed on fill tube 64 prevents excess air from reentering pump 16.

Figure 7:
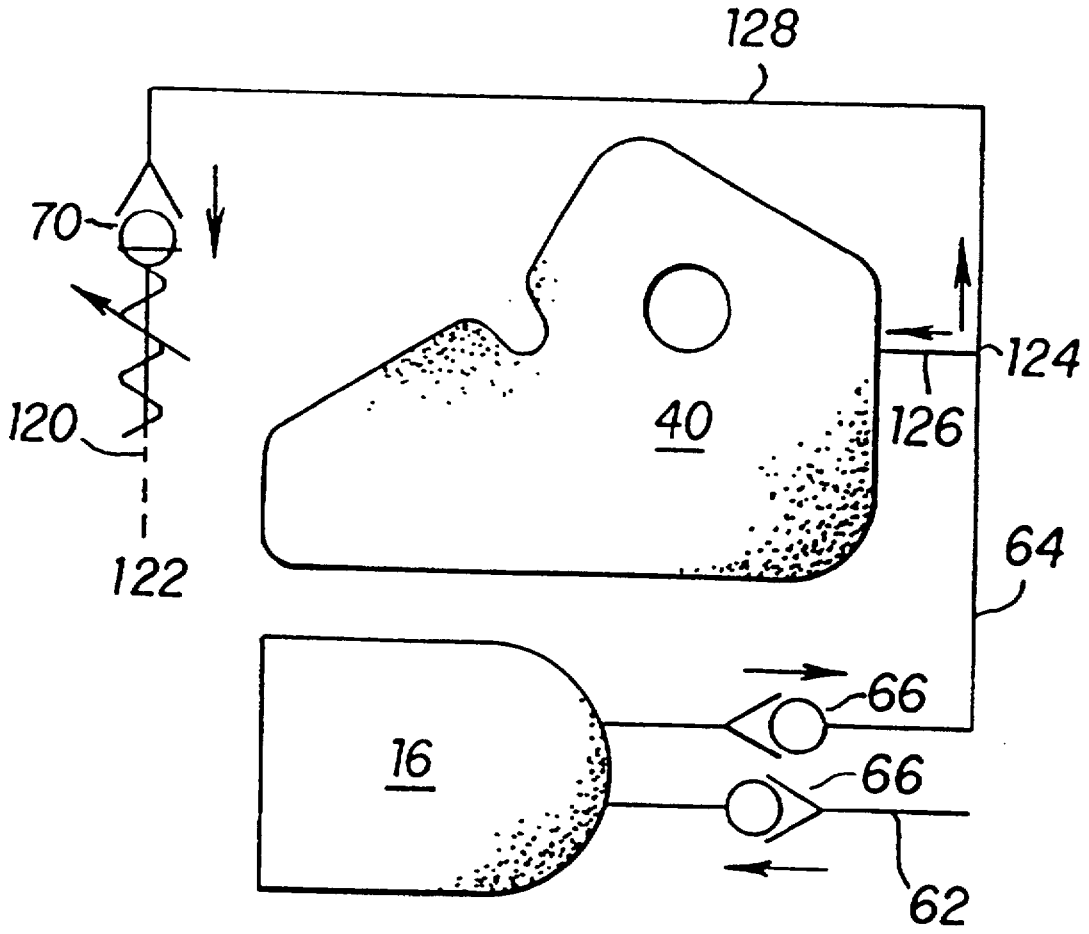
FIG. 7 shows an airflow schematic diagram of the support system of FIG. 6.

FIG. 7 shows an air flow schematic diagram for the embodiment of the present invention shown in FIG. 6. Air from the atmosphere is passed through pump tube 62 to pump 16. Air from pump 16 is passed through fill tube 64 to connector 124. Air from connector 124 is passed through bladder tube 126 to bladder 40. Excess air from bladder 40 is transferred through bladder tubes 126 to connector 124 and through regulator tube 128 to relief valve 70. Excess air from relief valve 70 is then vented to the atmosphere through vent tube 120.

Although not shown, one further embodiment of the invention might include a T-shaped connector rather than an X-shaped connector. In such an embodiment, air would be feed from pump 16 through fill tube 126 to one side of the T-shaped connector. The bottom of the T-shaped connector would be directly connected to bladder 40, thereby eliminating the need for bladder tubes 126. Excess air from bladder 40 would be vented back through the second side of the connector to a regulator tube 128 connected to relief valve 70. This arrangement would eliminate the need for bladder tubes 126 as shown in FIG. 6.

Figure 9:
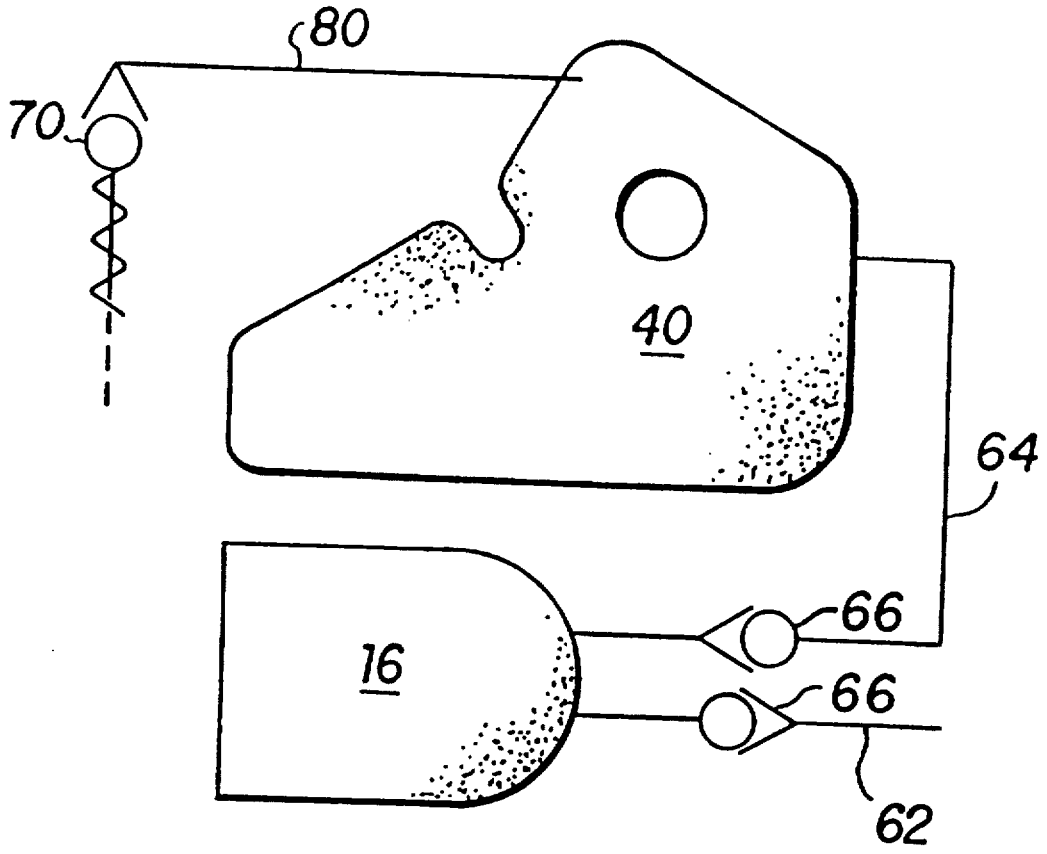
FIG. 9 is an airflow schematic diagram of an alternate embodiment of the support system of the present invention.

A more simple arrangement for the interior support system of the present invention is shown in the schematic diagram of FIG. 9. In this embodiment, fill tube 64 is directly connected to bladder 40. Relief valve 70 is also directly connected to bladder 40. This embodiment eliminates the need for both bladder tubes 126 and regulator tube 128. This embodiment would also provide increased cushioning by pump 16 on the heel portion of the sole of the foot because of the increased back pressure into pump 16 from relief valve 70.

Use of the embodiment of the present invention shown in FIG. 2 will now be described. After the wearer places his foot within foot opening 50, tongue 11 is adjusted and shoe laces 13 are tensioned to achieve proper fit. At this point, the wearer adjusts regulator 60 to the desired pressure setting, by rotating cap 106 of relief valve 70. As the wearer begins to walk or otherwise move in shoe 10, the heel of the wearer exerts pressure on top layer 18 of pump 16. Air from the atmosphere which has been vented through pump tube 62 into pump 16 is thereby forced into fill tube 64. Air from fill tube 64 is then passed through relief valve inlet 74 of relief valve 70. Orifice restrictor 76 controls the amount of air which may enter relief valve 70.

Once inside relief valve 70, air is transferred to bladder 40. Bladder 40 is inflated by the air which is being constantly forced thereto by pump 16. Hence, once the preselected air pressure has been achieved within bladder 40, excess air is passed back to the atmosphere through relief valve outlet 80, between annular seat 82 and valve head 88, and eventually through clearance gap 114.

The air pressure within bladder 40 affords support to the foot of a wearer otherwise unavailable from upper 14 alone. By constantly exerting pressure upon the foot, the foot is maintained in proper alignment within the shoe upper by bladder 40. Furthermore, bladder 40 provides increased cushioning to the foot by molding to the particular contour of the foot and thereby, accommodating for anatomical irregularities inherent in the human foot. Therefore, bladder 40 allows the wearer individualized interior sizing of shoe 10.

Additionally, bladder 40 prevents uncomfortable localized pressure from the fastening system of the shoe by providing a cushion between the foot and the fastening system. Bladder 40 provides uniform cushioning by which pressure from the fastening system is distributed across bladder 40. Furthermore, when filled with air, pump 16 provides cushioning for the heel of a wearer.

Moreover, the air within the support system is being constantly regenerated with each step of the wearer. This ensures that the preselected air pressure within bladder 40 remains constant.

Although pump 16 is shown in FIG. 2 as being disposed within upper 14 upon sole 12, pump 16 may be otherwise located in shoe 10. For example, pump 16 may be disposed within sole 12 between an insole and a midsole, between two layers of midsole, or between a midsole and an outsole.

Figure 10:
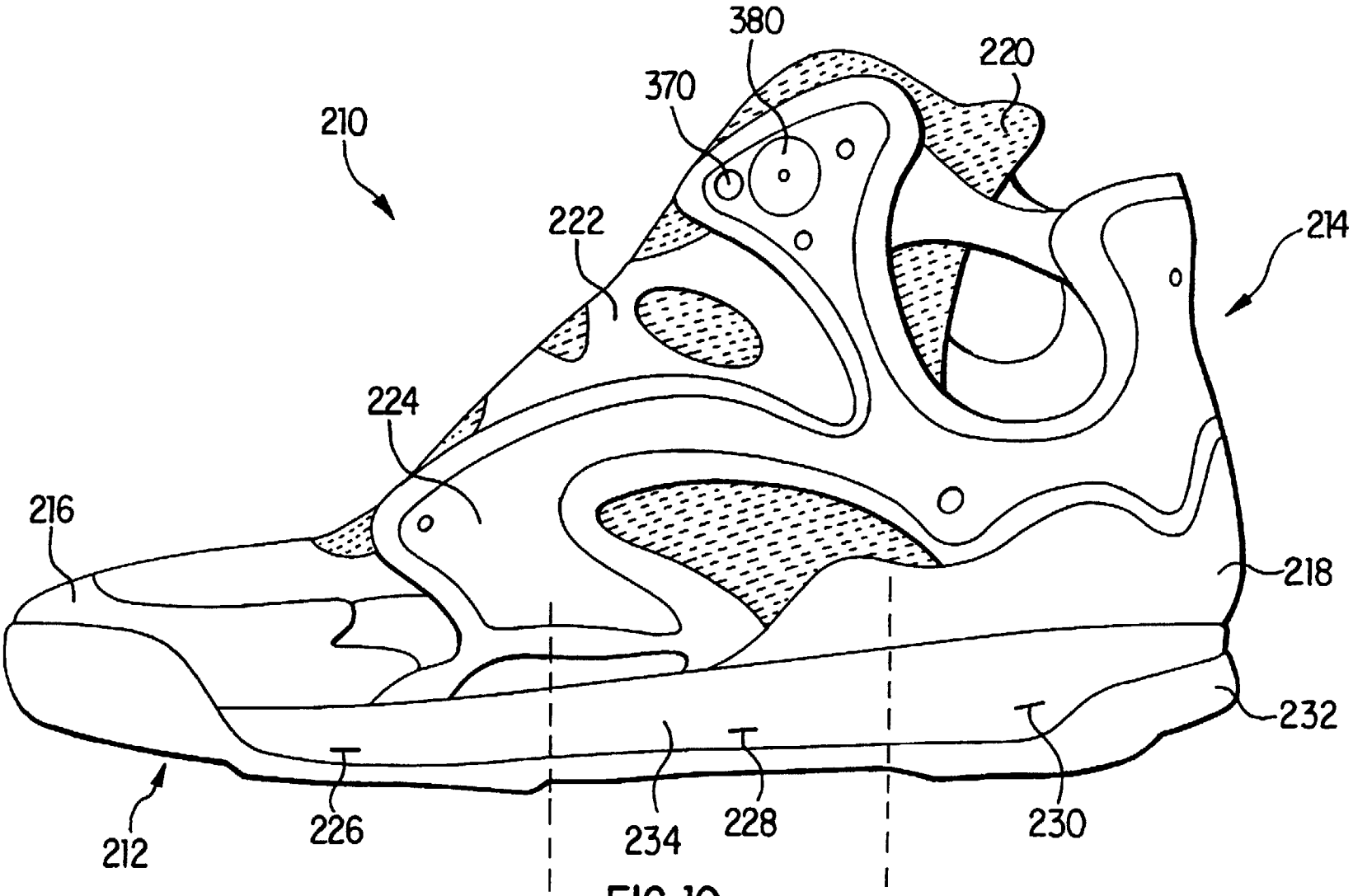
FIG. 10 is a right side elevational view of an article of footwear incorporating an alternate embodiment of a pumping chamber for producing a continuous supply of fluid.

Such an article of footwear having a pumping chamber disposed between a midsole and an outsole is illustrated at 210 in FIG. 10. Shoe 210 incorporates a "self-pumping" sole of the present invention which produces a continuous supply of fluid. This supply of fluid may be used to inflate the inflatable support system described above, or an alternative support system to be described in more detail below. Alternatively, the continuous supply of fluid may be used to pressurize a cushioning device (such as an air bag) or to provide ventilation to the foot of the wearer. Such applications of the supply of fluid will be discussed in greater detail below.

Similar to shoe 10 illustrated in FIG. 1, shoe 210 includes a sole 212 and an upper 214. Although FIG. 10 illustrates a shoe for the left foot, the principles of the present invention may be applied (in mirror image) to a shoe for the right foot.

With continuing reference to FIG. 10, upper 214 of shoe 210 includes a toe foxing 216, a heel counter 218, and a tongue 220. Tongue 220 provides cushioning to the instep of the wearer's foot. In place of the conventional lacing system of FIG. 1, shoe 210 is provided with an elastomeric strapping system 222 for maintaining the shoe on the foot of the wearer. Strapping system 222 may be molded from a polyurethane resin or other suitable material having an appropriate amount of stretch (for example, rubber). Shoe 210 may be provided with the lacing system of FIG. 1 or any other type of fastening mechanism, such as VELCRO™ straps. An inflatable bladder 224 which functions as the support system of the present invention is attached to the exterior surface of upper 214. Bladder 224, which is formed from two flat films, will be described in greater detail below.

Sole 212 of shoe 210 includes an outsole 232 and a midsole 234. Midsole 234 and outsole 232 together define the self-pumping chambers of the present invention. The midsole and outsole of sole 212 may be generally segmented to define a forefoot region 226, an arch region 228 and a heel region 230.

Figure 11:
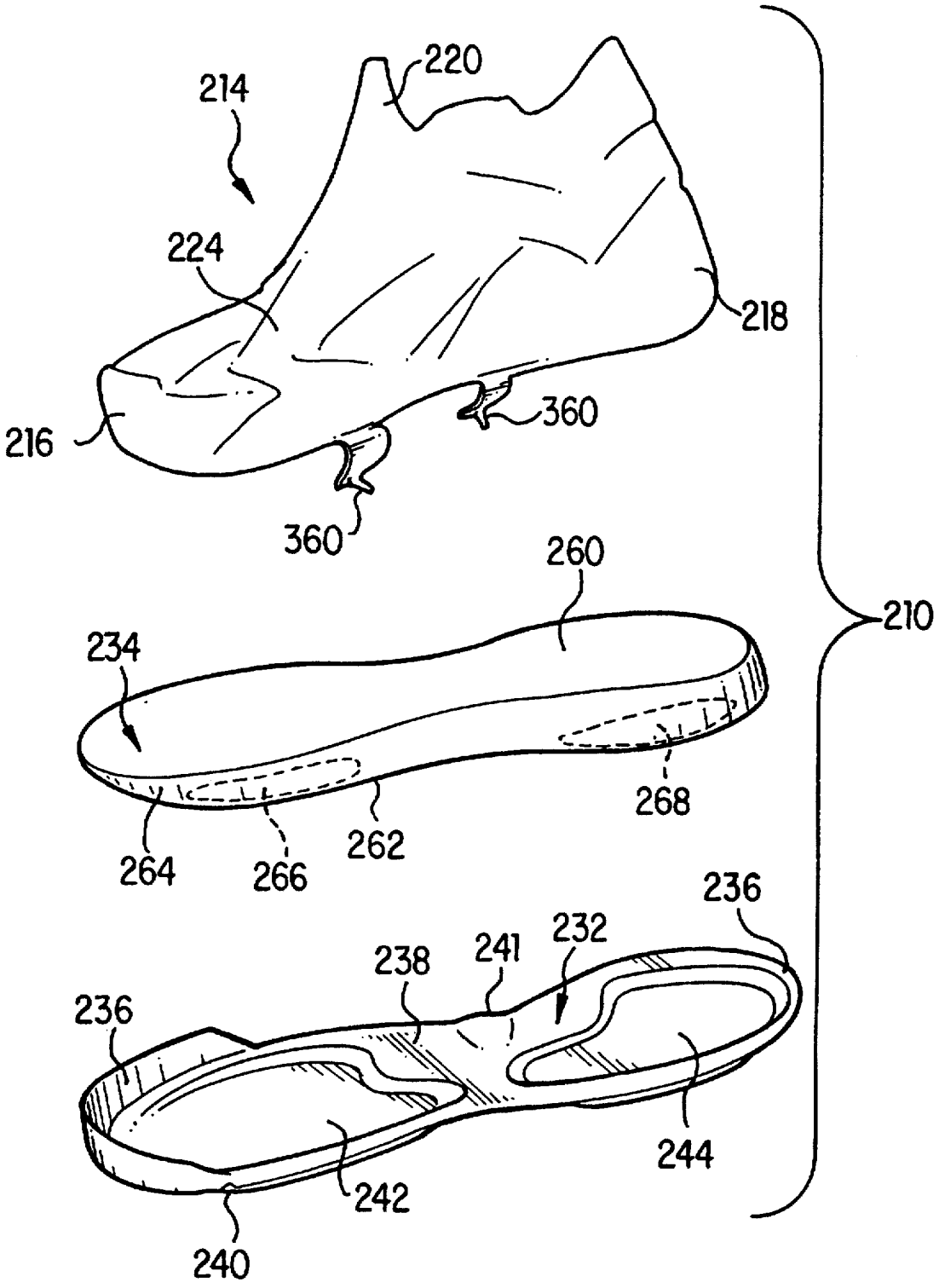
FIG. 11 is an exploded perspective view of the article of footwear shown in FIG. 10.

Turning now to FIG. 11, an exploded view of shoe 210 is shown. As seen in this embodiment of the present invention, outsole 232 is formed separately from midsole 234 of the invention. Outsole 232 includes a top surface 238, a bottom surface 240, and a peripheral wall 241 which ranges in thickness between 2.0 and 5.0 mm. Outsole 232 is generally cup-like in shape as it includes an upstanding side wall or lip 236 which extends about the outer perimeter of forefoot region 226 and heel region 230 (see FIGS. 11 and 13).

Outsole 232 is compression (or press) molded from an abrasive resistant material to form an outsole component having a forefoot concavity 242 and a heel concavity 244. A suitable material for the outsole of the present invention is INDY 500™ rubber available from Goodyear Tire Co., Akron, Ohio. It should be realized by those skilled in the art that outsole 232 may be molded from any other material having abrasive resistant properties. To form the outsole component of the invention, a suitably sized piece of rubber is pressed between two heated metal plates. The bottom plate includes a foot-shaped depression having a first concavity in the forefoot region of the outsole and a second concavity in the heel region of the outsole. A tread pattern defining lugs 246 (see FIG. 12) may be provided along the imprinting surface of the bottom plate to provide increased traction to the bottom surface of the outsole.

The top plate of the mold includes a protrusion which corresponds in contour and shape to the depression of the bottom plate. The protrusion of the top plate includes a first protuberance in the forefoot region a second protuberance in the heel region. The first and second protuberances of the top plate correspond in contour and location to the first and second concavities of the bottom plate. When properly pressed together, the first and second protuberances of the top plate fit within the first and second concavities of the bottom plate to form the forefoot and heel concavities of outsole 232.

With reference now to FIGS. 12–16, the forefoot and heel concavities of outsole 232 will be described. As best shown in the top plan view of FIG. 13, the forefoot and heel concavities of the outsole are configured to duplicate that part of the human foot which comes into contact with the ground as the foot passes through the gait cycle. Such a configuration is critical for efficiently displacing fluid from the pumping chambers of the sole. The displacement of fluid by the pumping chambers will be discussed in more detail below. Forefoot concavity 242 is generally tear-drop shaped and includes a metatarsal section 248, a lateral forefoot extension 250 and a medial forefoot extension 252. Metatarsal section 248 underlies the metatarsal ball of the wearer's foot to define the largest portion of the forefoot concavity. Lateral extension 250 extends along the lateral or outer edge of the shoe, while medial extension 252 extends along the medial or inner edge of the shoe. It should be noted that lateral extension 248 is longer than medial extension 250 to accommodate rolling of the foot along the lateral edge of the shoe as it passes through the gait cycle.

Figure 14:
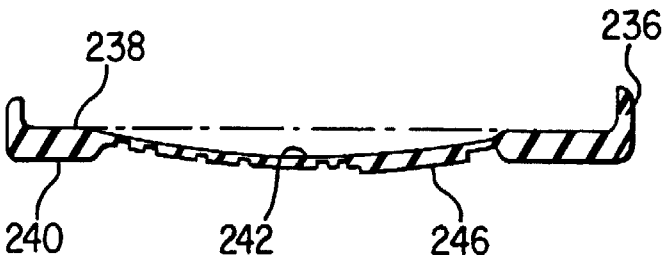
FIG. 14 is a cross-sectional view of the outsole taken along line 14—14 of FIG. 12.
Figure 16:
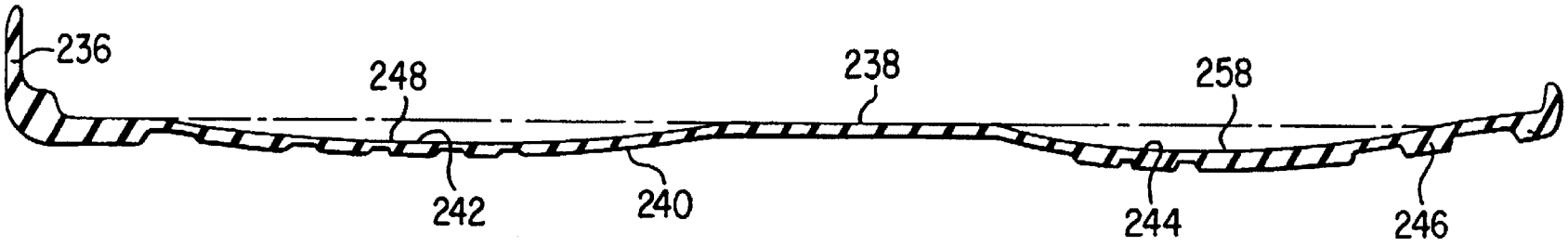
FIG. 16 is a cross-sectional view of the outsole taken along line 16—16 of FIG. 12.

As seen in FIGS. 14 and 16, forefoot concavity 242 increases in depth as it extends towards the mid-section thereof. At its deepest point within metatarsal section 248 (where the metatarsal heads of the foot contact the ground), forefoot concavity 242 is approximately 3.5 mm deep. Although the depth of the forefoot concavity may be increased or decreased (to increase or decrease the volume of the forefoot chamber), the forefoot concavity should not extend more than 8.0 mm below bottom surface 240 of outsole 232 to avoid interfering with the gait cycle of the wearer or producing a feeling of instability.

Figure 12:
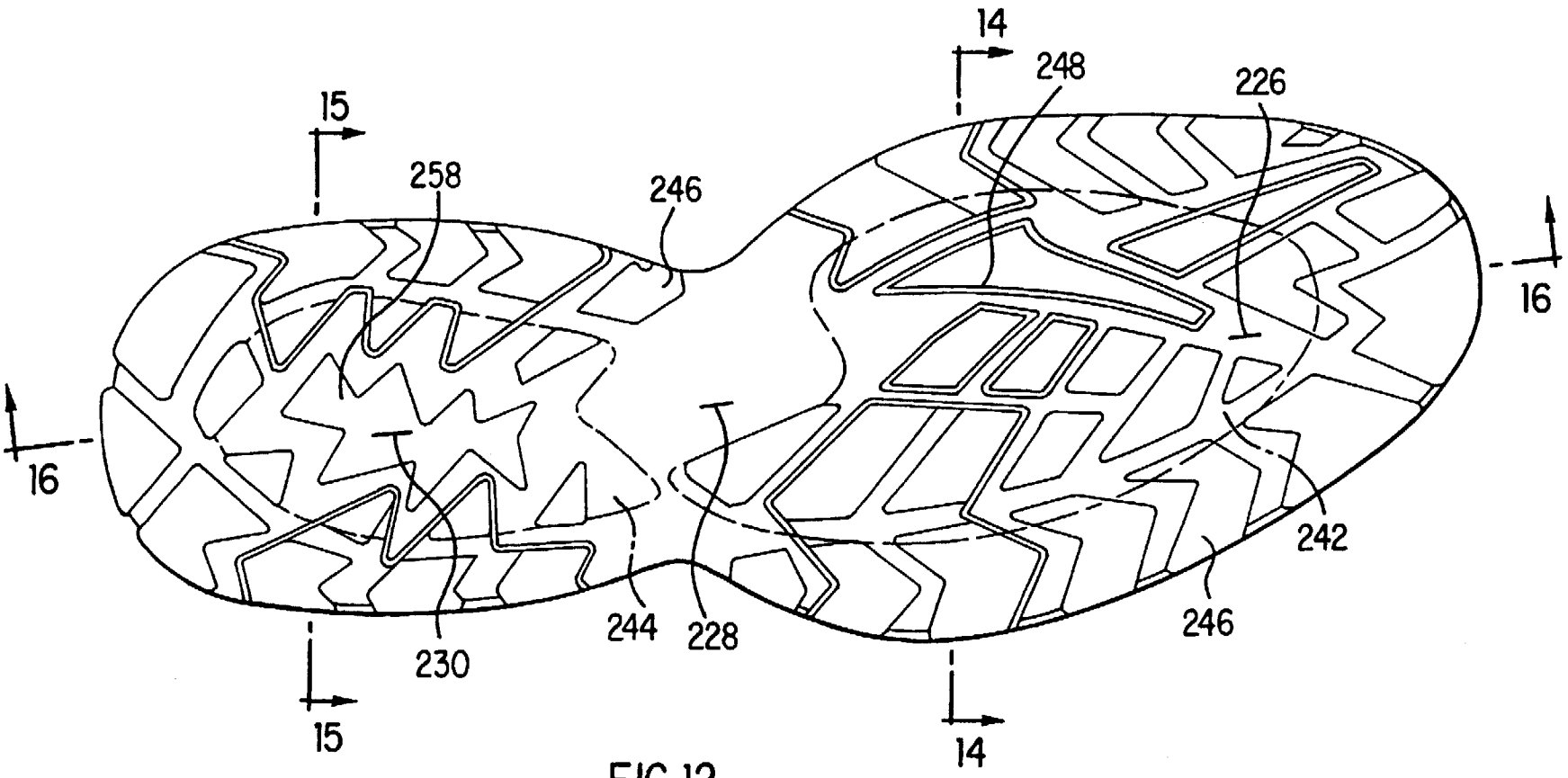
FIG. 12 is a bottom plan view of the outsole shown in FIG. 11.
Figure 13:
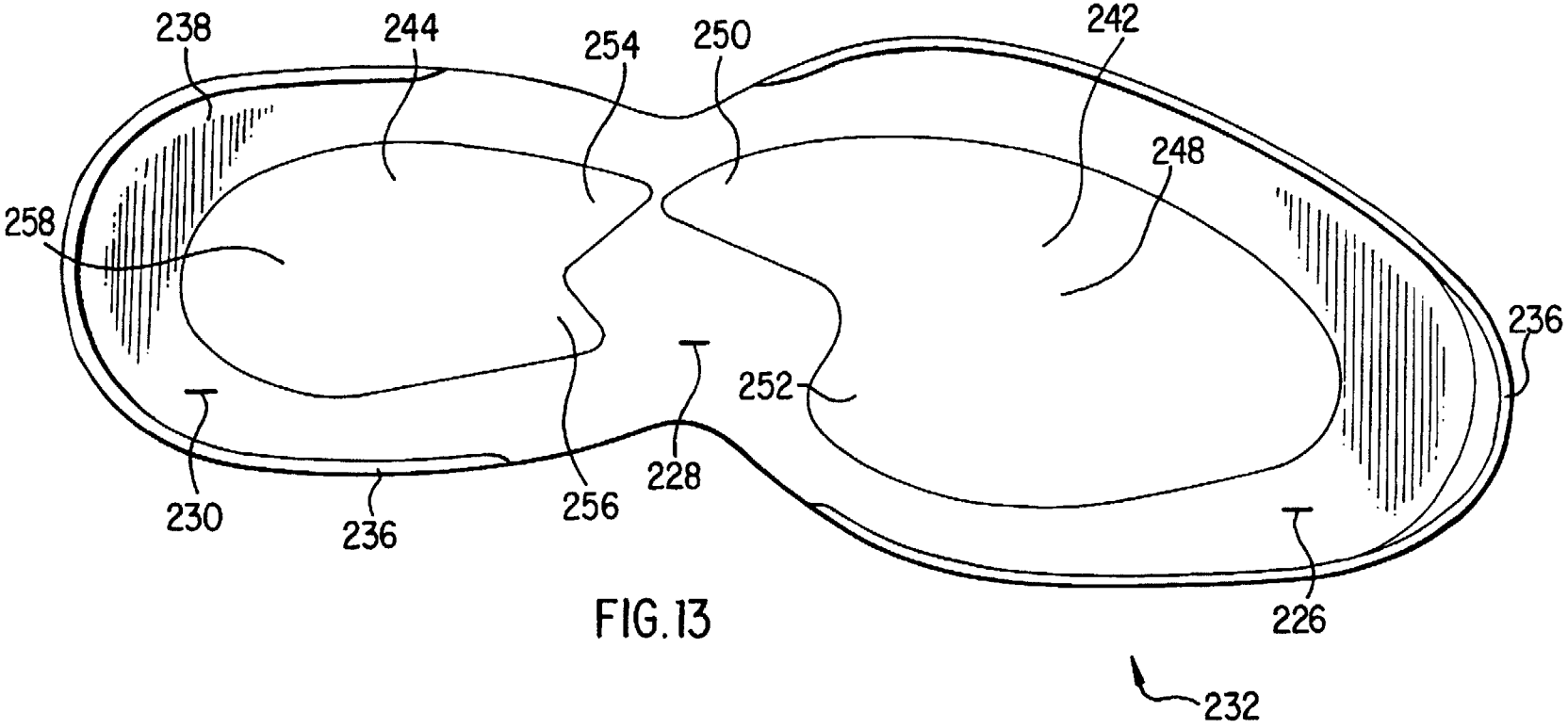
FIG. 13 is a top plan view of the outsole shown in FIG. 11.

Heel concavity 244 is also tear-drop in shape (see FIGS. 11–13). The largest section of heel concavity 244 is located beneath the calcaneus of the foot. Heel concavity 244 includes a lateral heel extension 254 extending along the lateral edge of the heel and a medial heel extension 256 extending along the medial edge of the heel. Like forefoot concavity 242, lateral heel extension 254 extends beyond medial heel extension 256 to accommodate the rolling of the foot along the lateral edge of the shoe.

Figure 15:
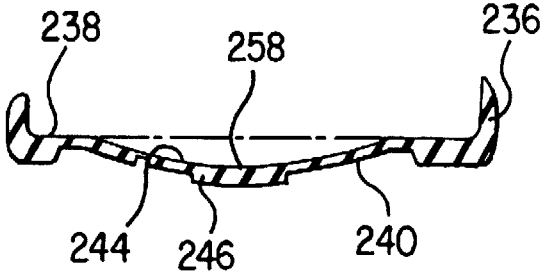
FIG. 15 is a cross-sectional view of the outsole taken along line 15—15 of FIG. 12.

As best seen in FIGS. 15 and 16, heel concavity 244 increases in depth as it extends toward mid-section 258. At its deepest point, heel concavity 244 is approximately 5.5 mm deep. Although the depth of the heel concavity may be increased or decreased (to increase or decrease the volume of the heel chamber), the heel concavity should not extend more than 10 mm below the bottom surface of the outsole to avoid the undesired effects discussed above with respect to the forefoot concavity.

Figure 17:
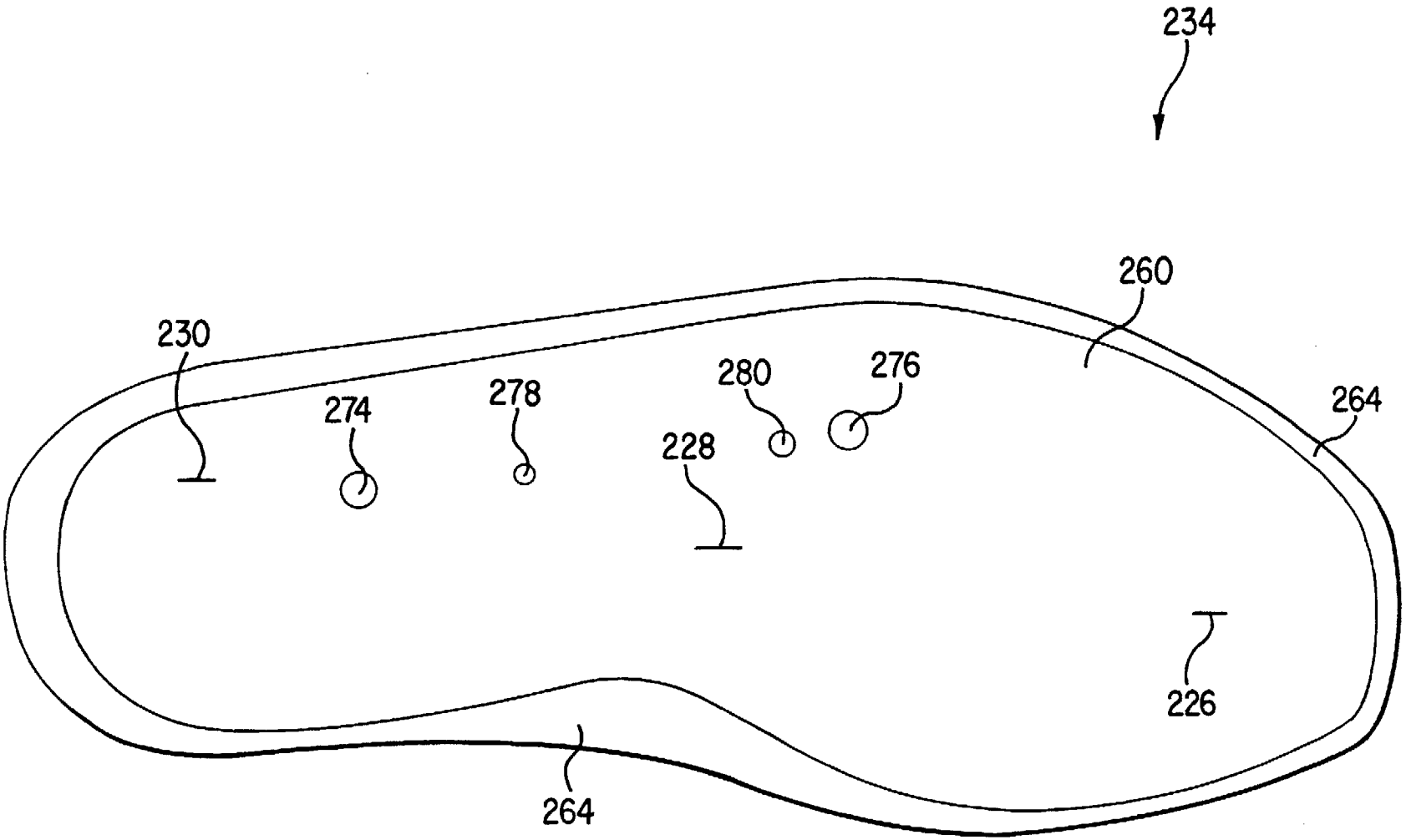
FIG. 17 is a top plan view of the midsole shown in FIG. 11.
Figure 18:
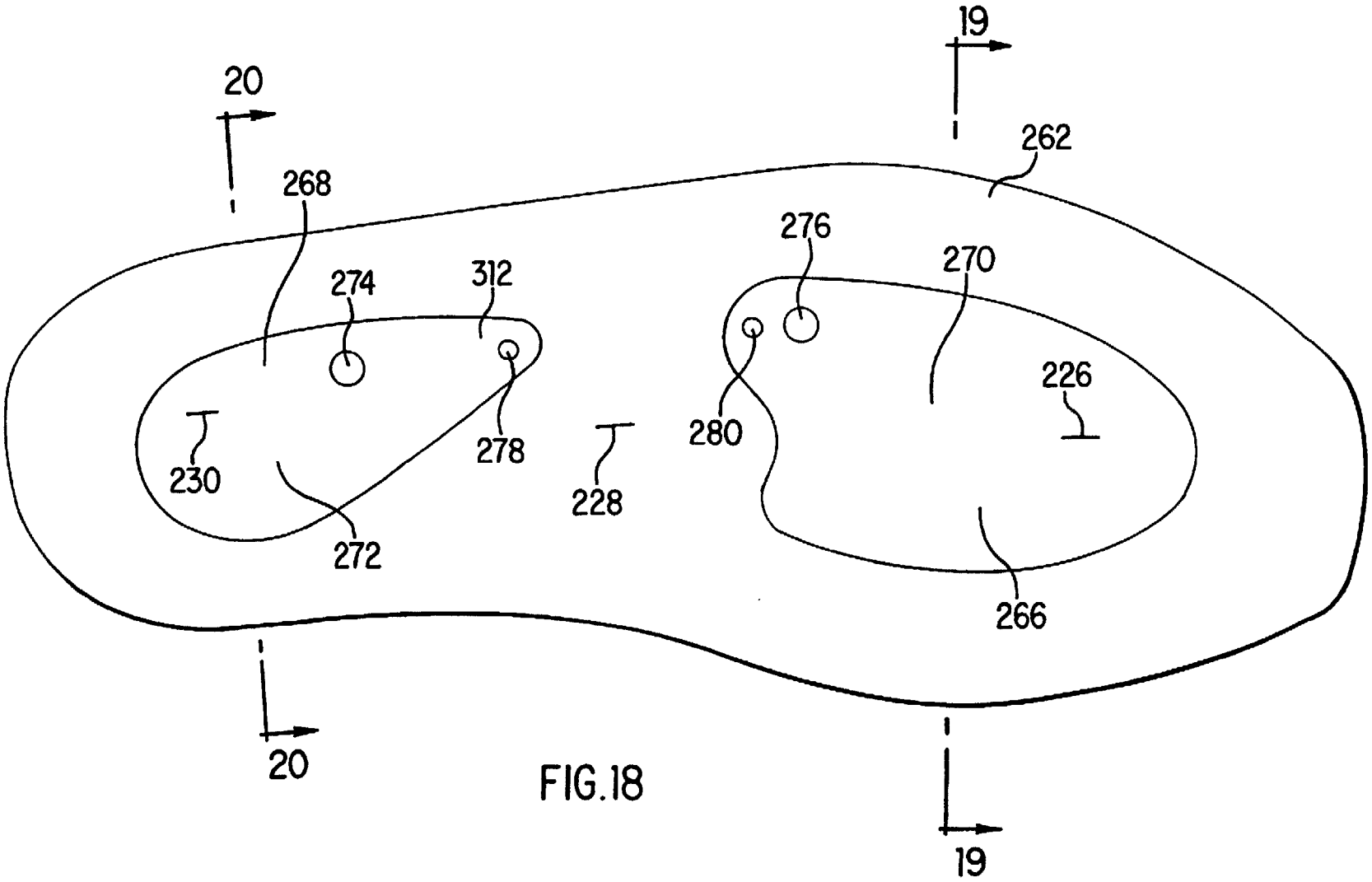
FIG. 18 is a bottom plan view of the midsole shown in FIG. 11.
Figure 19:
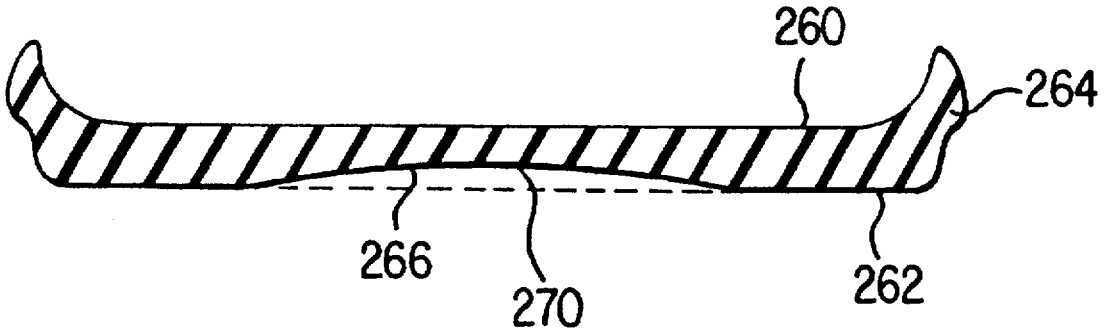
FIG. 19 is a cross-sectional view of the midsole taken along line 19—19 of FIG. 18.

Having described outsole 232, midsole 234 will now be described with particular reference to FIGS. 11 and 17–20. Midsole 234 includes a top surface 260, a bottom surface 262, and a side wall 264. Midsole 234 decreases in thickness as it extends from heel region 230 to forefoot region 226. The thickness of midsole 234 may range from 5.0 mm to 25.0 mm. As best seen in FIG. 17, side wall 264 of midsole 234 flares outwardly from top surface 260 to bottom surface 262 to provide a stable platform for the foot of the wearer. Midsole 234 is compression or press molded from a cushioning material, such as foamed ethyl vinyl acetate (EVA) or polyurethane (PU). ECLIPSE 5000™, available from Eclipse, Polymers, Pusan, Korea, is a suitable material for forming midsole 234. It should be realized by those skilled in the art that any other cushioning material capable of being compression molded is suitable for forming midsole 234. To form the midsole of the invention, a suitably sized piece of cushioning foam is pressed between two heated metal plates. The bottom plate of the mold includes a forefoot protuberance in the forefoot region of the plate and a heel protuberance in the heel region of the plate. Although smaller in dimension, the forefoot and heel protuberances of the bottom plate of the midsole mold generally correspond in shape and location to the forefoot and heel concavities of outsole 232. The top plate of the midsole press is smooth, including no surface indentations or protrusions. When properly pressed together, the forefoot and heel protuberances of the bottom plate press within the bottom surface of midsole 234 to form a forefoot recess 266 and a heel recess 268 (see FIG. 18). With continuing reference to FIGS. 11 and 17–20, the forefoot and heel recesses of midsole 234 will now be described. As best shown in the bottom plan view of FIG. 18, forefoot recess 266 and heel recess 268 generally correspond in shape to forefoot concavity 242 and heel concavity 244 of outsole 232. Although not required, the forefoot and heel recesses of the midsole function to increase the volume of the forefoot and heel pumping chambers (to be described in more detail below). As seen in FIG. 19, forefoot recess 266 increases in height as it extends toward the mid-section thereof. At its highest point 270, forefoot recess 266 is approximately 1.5 mm high. Although the forefoot recess may be increased in height or even eliminated from the midsole, the recess should not be more than approximately 5.0 mm high to prevent the midsole from excessive stress when collapsing from movement of the wearer's foot.

Figure 20:
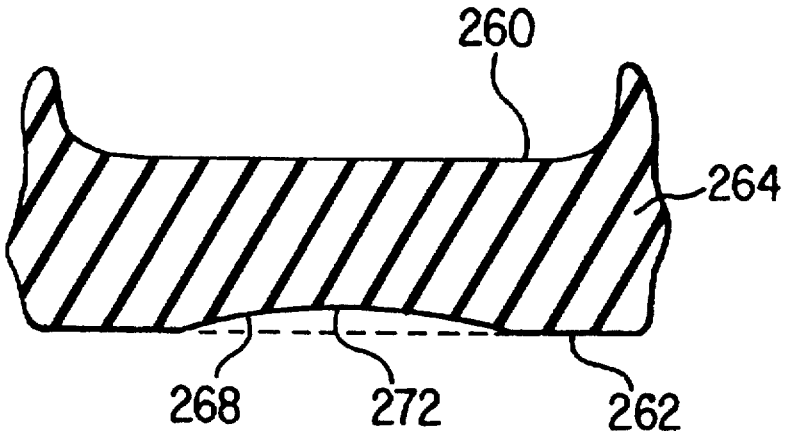
FIG. 20 is a cross-sectional view of the midsole taken along line 20—20 of FIG. 18.

As shown in FIG. 20, heel recess 268 also increases in height as its extends toward the mid-section thereof. At its highest point 272, heel recess 268 is approximately 2.0 mm. For reasons previously discussed, the height of heel recess 268 should not exceed 5.0 mm.

To form the self-pumping sole of the present invention, the top surface of outsole 232 is placed in a facing relationship with the bottom surface of the midsole 234. Midsole 234 may be permanently attached to outsole 232 by placing a suitable adhesive or other bonding agent along the periphery of top surface 238 of outsole 232. The top surface of the outsole is then brought into contact with the bottom surface of the midsole. When properly bonded together, forefoot concavity 242 and forefoot recess 266 form a forefoot pumping chamber 320, while heel concavity 244 and heel recess 268 form a heel pumping chamber 340 (see FIG. 24).

It should be noted by those skilled in the art that forefoot and heel pumping chambers 320, 340 may have shapes other than that disclosed herein. For example, the chambers may be elliptical or oblong shaped depending upon the volumetric requirements of the chambers or the desired cosmetic appearance. In addition, the forefoot and heel pumping chambers may have dimensions other than those previously described. It should also be noted that the self-pumping chambers need not be formed between a separately molded midsole and outsole. For example, the self-pumping chambers may be blow molded into a midsole or outsole component.

Figure 24:
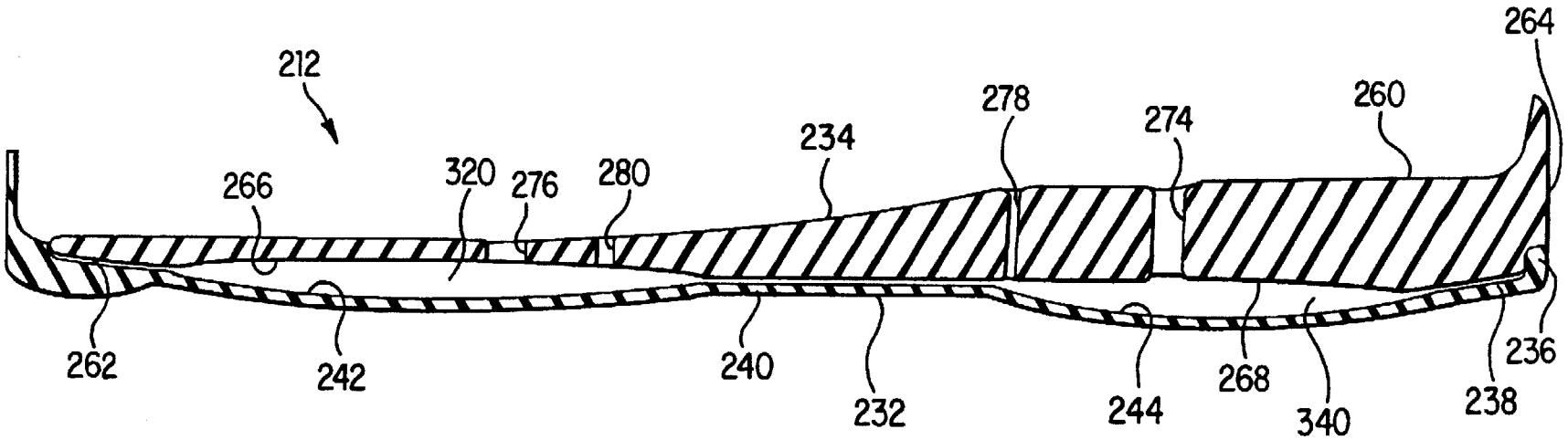
FIG. 24 is a cross-sectional view of the midsole and outsole of the present invention illustrating the flow of fluid therethrough.

Fluid, such as air, is drawn into and expelled from the forefoot and heel pumping chambers by an inlet and outlet system. It should be noted that both the inlets and outlets of the invention are open to the interior of shoe 210 to prevent the same from becoming clogged by dirt or other particulate matter. In addition, it should be noted that the inlets and outlets of the invention are vertically disposed within the midsole to eliminate the need for additional tubing which would otherwise complicate and increase the cost of manufacturing. With reference now to FIGS. 17, 18 and 24, the fluid inlets of the present invention will be described. A first fluid inlet 274 for permitting the flow of fluid through midsole 234 is disposed (or bored) within heel region 230. Inlet 274, which is approximately 20 mm in length, extends through the thickness of midsole 234 from top surface 260 to bottom surface 262. As best seen in FIG. 24, inlet 274 extends through midsole 234 and opens into heel recess 268. When the midsole and outsole are joined together, inlet 274 is in fluid communication with the interior of heel pumping chamber 340. Inlet 274 is generally cylindrical in shape having a diameter of approximately 6 mm. Inlet 274 is dimensioned to receive an inlet check valve which permits the one-way flow of fluid into the pumping chamber. Inlet 274 may be otherwise dimensioned to receive an inlet check valve of any size.

Although inlet 274 is positioned along the lateral edge of the shoe (as shown in FIGS. 17 and 18) it should be noted that inlet 274 may be positioned anywhere along the midsole, so long as the inlet is in fluid communication with the heel pumping chamber of the sole.

A second fluid inlet 276 is disposed within forefoot region 226 of midsole 234. Inlet 276 is approximately 15 mm in length and extends through the thickness of midsole 234. As best seen in FIG. 24, inlet 276 opens into forefoot recess 266. When the midsole and outsole are joined together, inlet 276 is in fluid communication with the interior of the forefoot pumping chamber. Inlet 276 is also cylindrical in shape and has a diameter of approximately 6 mm. Inlet 276 is dimensioned to receive an inlet check valve which permits the one-way flow of fluid into the forefoot pumping chamber. Like inlet 274, inlet 276 may be dimensioned to accommodate an inlet check valve of any size depending upon the fluid requirements of the pumping chamber. Similarly, inlet 276 may be positioned anywhere along the surface of the midsole so long as the inlet is in fluid communication with the forefoot pumping chamber of the sole.

Having described the inlets of the invention, the outlets of the self-pumping sole will now be described. A first fluid outlet 278 for permitting the flow of fluid out of heel pumping chamber 340 is disposed within heel region 230 of midsole 234. Outlet 278, which is approximately 20 mm in length, extends through the thickness of midsole 234 from top surface 260 to bottom surface 262. As best seen in FIG. 24, outlet 278 opens into heel recess 268. When the midsole and outsole are joined together, outlet 278 is in fluid communication with the interior of the heel pumping chamber 340. Outlet 278 is cylindrical in shape having a diameter of approximately 3.5 mm. Outlet 278 is dimensioned to receive an outlet check valve (described below) which permits the flow of fluid out of the heel pumping chamber. Although outlet 278 may be placed in a location other than that shown in FIGS. 17, 18 and 24, it is preferred that outlet 278 be placed near end 312 of heel recess 268 (see FIG. 18). As the wearer's heel strikes the ground and rolls forward to the toe of the shoe, a "bubble" of fluid is pushed to the forward end of heel pumping chamber 340. By placing the outlet at the end of that fluid path, the outlet is in fluid communication with the highest concentration of fluid within the heel pumping chamber.

A second fluid outlet 280 for permitting the flow of fluid out of forefoot pumping chamber 320 is disposed within forefoot region 226 of midsole 234. Outlet 280 is approximately 15 mm in length and extends through the thickness of midsole 234. As best seen in FIG. 24, outlet 280 extends through midsole 234 to open into forefoot recess 266. When the midsole and outsole are joined together, outlet 280 is in fluid communication with the interior of forefoot pumping chamber 320. Outlet 280 is cylindrical in shape, having a diameter of approximately 3.5 mm. Like outlet 278, outlet 280 is dimensioned to receive an outlet check valve which permits the flow of fluid out of the forefoot pumping chamber. Outlet 280 may be otherwise dimensioned to receive an outlet check valve of any size or shape. It should be noted by those skilled in the art that outlet 280 may be disposed at a location other than that shown in FIGS. 17, 18 and 24.

Figure 21:
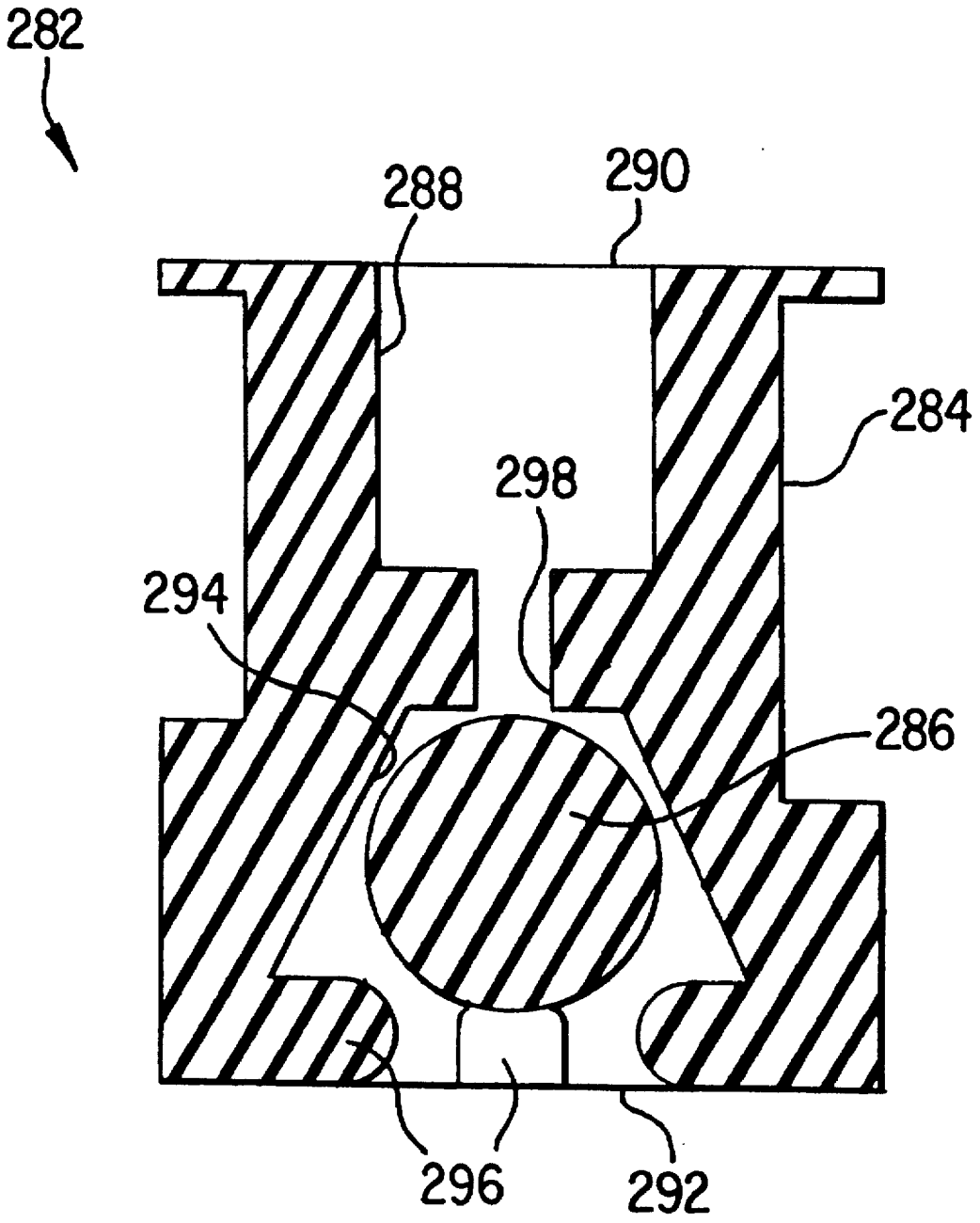
FIG. 21 is a cross-sectional view of an inlet check valve.

Disposed within first and second inlets 274, 276 is an inlet check valve for permitting the flow of fluid into heel and forefoot pumping chambers 340, 320. With reference now to FIG. 21, the inlet check valve of the present invention is shown generally at 282. Inlet check valve 282 includes a housing 284 which receives a free-floating valve ball 286. Housing 284 defines a central passageway 288 having an entrance opening 290 and an exit opening 292. Within the mid-section of passageway 288 a cone-shaped valve ball seat 294 is formed. At exit opening 292, a plurality of retaining arms 296 are provided. Retaining arms 296 maintain valve ball 286 within the central passageway of the housing. Inlet check valve 282 is press fit into inlets 274, 276 such that exit opening 292 of valve 282 opens into the recesses of the midsole.

Having described its component parts, operation of the inlet check valve will now be described. When the forefoot or heel pumping chamber is relieved of pressure, a fluid, such as ambient air, enters the inlet check valve (from the interior of the shoe) through entrance opening 290. From entrance opening 290, air travels through central passageway 288, around valve ball 286, and into heel or forefoot pumping chamber through exit opening 292. Valve ball 286, which is free-floating within central passageway 288, is retained within the check valve housing by retaining arms 296. As pressure is applied to the heel or forefoot pumping chamber, the increase in pressure forces valve ball 286 against cone-shaped seat 294. As the valve ball is forced against the cone-shaped seat, the central passageway of the valve is blocked and air is prevented from flowing around valve ball 286 and out of the chamber through the inlet check valve. Thus, inlet check valve 282 enables fluid to flow in one direction, i.e., from the interior of the shoe into a pumping chamber.

Although the components of the inlet check valve are preferably formed from nylon, they may be formed from any other material capable of being molded to a particular specification, such as polyurethane. An inlet check valve suitable for accomplishing the objectives of the present invention is sold by Vernier Laboratories, Yellow Springs, Ohio.

Figure 22:
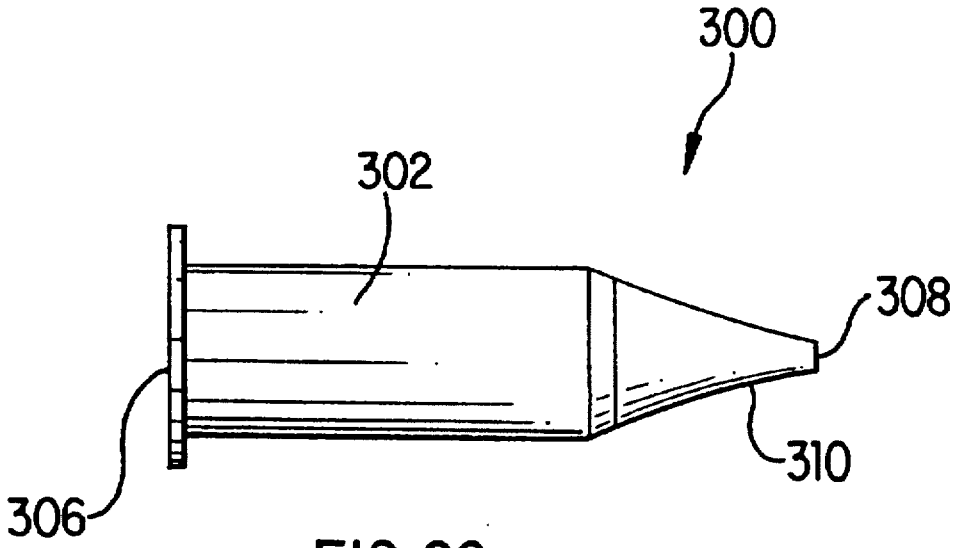
FIG. 22 is a side elevational view of an outlet check valve.
Figure 23:
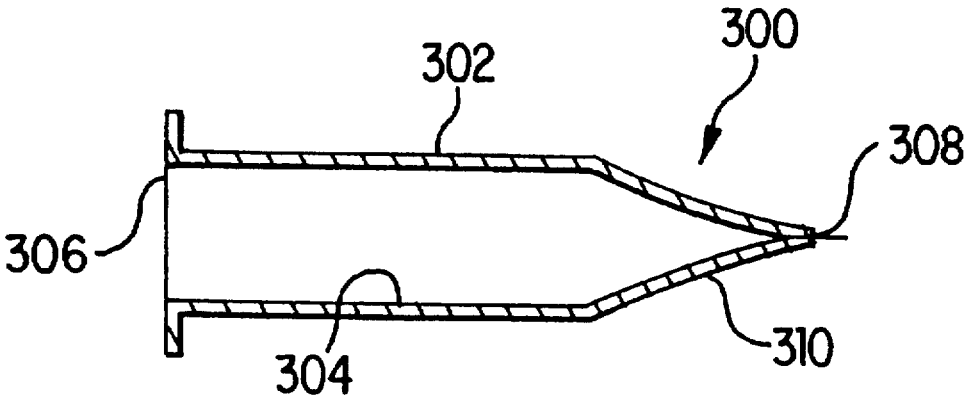
FIG. 23 is a cross-sectional view of an outlet check valve.

Disposed within outlets 278, 280 is an elastomeric outlet check valve for enabling the flow of fluid out of the heel and forefoot pumping chambers. With reference now to FIGS. 22 and 23, the outlet check valve of the present invention is shown generally at 300. Outlet check valve 300 includes a tubular body 302 which defines a central passageway 304 having an entrance opening 306 and an exit opening 308. Tip 310 narrows in diameter to form a duck-bill closure at exit opening 308. The nature of the elastomeric material of the outlet check valve (and the back pressure of the fluid within the chamber) inherently maintains the duck-billed exit opening in a closed position to prevent the flow of fluid back into the chamber. A suitable outlet check valve is manufactured by Vernier Laboratories, Yellow Springs, Ohio.

Outlet check valve 300 is press fit into outlets 278, 280 such that entrance opening 306 opens into the recesses of the midsole. When a pressure is applied to the forefoot or heel pumping chamber, the increase in pressure forces air within the confines of the chamber into the outlet check valve through entrance opening 306. From the entrance opening, fluid is channeled to the duck-billed tip of exit opening 308 through passageway 304. As the fluid reaches tip 310 of the outlet check valve, exit opening 308 is forced open to allow fluid to flow out of outlet check valve 300 to its ultimate destination. After exiting the outlet check valve, fluid is prevented from re-entering the chamber by the inherently closed duck-billed tip of exit opening 308. Thus, outlet check valve 300 enables fluid to flow in one direction, i.e., out of a pumping chamber.

Having described the component parts of sole 212, the production of a continuous supply of fluid will be described with respect to FIG. 24. To produce a continuous supply of fluid using the self-pumping sole of the present invention, a user's foot is placed upon a conventional insole or sockliner (not shown) disposed above midsole 234. Although ambient air is capable of flowing beneath the insole or sockliner of the shoe, the insole or sockliner may be perforated to facilitate the flow of air from within the confines of the shoe to the inlet check valves. As the heel of the shoe is lifted by the wearer, air from within the interior of the shoe flows into inlet 274 through heel inlet check valve 282. Similarly, as the forefoot portion of the foot is lifted off of the ground, air flows into inlet 276 through forefoot inlet check valve 282. As the heel of the wearer strikes the ground (that is, as a force is applied to heel pumping chamber 340), the pressure of the air within the heel pumping chamber increases. This increase in pressure causes valve ball 286 of inlet check valve 282 to come into contact with valve ball seat 294 to prevent air from flowing back through the heel inlet and into the shoe. As the wearer travels through the gait cycle, air within the heel pumping chamber is channeled to the outlet of the chamber and out of the sole through outlet check valve 300. As the heel of the wearer leaves the ground (that is, as the wearer rolls forward to the forefoot portion of the foot) air is prevented from flowing back into the chamber by the inherently closed duck-bill exit opening of outlet check valve 300.

As the wearer's foot rolls onto the forefoot pumping chamber, the pressure of the air within the forefoot pumping chamber increases. This increase in pressure closes inlet check valve 282 in the manner previously described. As the wearer travels forward along the forefoot pumping chamber, air within the confines of the chamber is displaced or pushed into the outlet of the chamber and out of the sole through outlet check valve 300. As the forefoot of the wearer leaves the ground (that is, as the pressure on the chamber decreases), air is prevented from flowing back into forefoot pumping chamber by outlet check valve 300. Absent the application of a force to the forefoot and heel pumping chambers of the sole, air from within the interior of the shoe flows into the chambers through the inlet check valves in the manner previously described. Thus, by providing forefoot and heel pumping chambers between the midsole and outsole of a shoe, a continuous supply of fluid may be produced in response to the gait of a wearer.

It should be noted by those skilled in the art that forefoot and heel pumping chambers 320, 340 not only provide a continuous supply of fluid, they also provide cushioning to the foot of the wearer in both the heel and forefoot regions of the shoe. In addition, the self-pumping sole of the present invention is efficient in that it is activated by movement of the wearer's foot. Furthermore, the self-pumping sole of the present invention is inexpensive to manufacture because it is formed between the outsole and midsole of the shoe and does not entail the use of tubing or other connecting means.

Applications of the Self-Pumping Sole

The supply of fluid which is continuously produced by the self-pumping sole of the present invention may be used to accomplish several objectives. As stated previously in this application, the supply of fluid may be used to inflate an inflatable bladder such as that shown in FIGS. 1 and 10 to improve the fit of the upper about the foot of the wearer. In order to inflate bladder 40 of shoe 10 (FIGS. 1 and 2), the outlets of the forefoot and heel pumping chambers may be connected to the inlet of the bladder via tubing 64. Tubing 64 may be provided with a suitable connector structured to mate with the outlets of the pumping chambers. The fluid within bladder 40 would be continuously regenerated via the self-pumping sole of the present invention in order to overcome the bladder diffusion problems common in prior art devices. If desired, regulator 60 could be used in combination with the self-pumping sole of the present invention to maintain the bladder at a constant pressure.

Similarly, the self-pumping sole of the present invention could be used to inflate bladder 224 of shoe 210. With reference to FIG. 11, bladder 224 of shoe 10 may be inflated by inserting a bladder inlet 360 into each pumping chamber outlet. Each bladder inlet 360 may preferably be provided with a male connector (FIG. 11) to enable the flow of fluid between the outlets of the chambers and the inlets of bladder 224. As seen in FIG. 10, bladder 224 is slightly different than that shown in FIG. 2, as bladder 224 is attached to the exterior of upper 210. The construction of such a bladder is disclosed in U.S. Pat. No. 5,343,638, the specification of which is incorporated herein by reference. If desired, a release valve 370 and a supplemental inflation mechanism 380 (in the form of a latex rubber, digitally operated pump) may be provided in fluid communication with bladder 224. A suitable release valve and supplemental inflation mechanism are also disclosed in U.S. Pat. No. 5,343,638. This application of the present invention is particularly efficient in that it eliminates the need for excess tubing between the chambers of the sole and the bladder.

In addition to providing a fluid source for an inflatable bladder, the self-pumping sole of the present invention may be used to provide ventilation to the foot of the wearer. In one embodiment, fluid from the pumping chambers of the sole is allowed to flow out of the outlets to circulate air beneath an insole or sockliner of the shoe. In another aspect of this embodiment, a tube may be connected to the outlets of the pumping chambers to deliver air to the upper of the foot above the sockliner.

In yet another embodiment, the self-pumping sole of the invention could be used to constantly regenerate the supply of air to a pneumatic cushioning device. Such a cushioning device could be placed in fluid communication with the outlets of the pumping chambers by tubing or other suitable connecting means. For example, pump 16 of FIG. 2 may be converted to a pneumatic cushioning device by eliminating outlet port 36 and connecting a fluid tube from forefoot and heel pumping chambers 320, 340 to inlet 62 of pump 16.

It is also envisioned that the self-pumping chambers of the present invention could be used to generate an air supply and provide circulation for a walking-type cast for a leg.

It should be understood that the foregoing disclosure relates only to presently preferred embodiments, and that it is intended to cover all changes and modifications of the invention herein chosen for the purpose of the disclosure which do not constitute departures from the spirit and scope of the invention as set forth in the appended claims.

What is claimed is:

1. An article of footwear, comprising:

an upper defining an interior for receiving a foot of a wearer;

a sole attached to said upper, said sole comprising a midsole having a thickness and an outsole having a thickness, said midsole and said outsole being joined to define a chamber for receiving a fluid, said chamber having a top wall and a bottom wall;

a chamber inlet for providing a fluid passageway between said interior of said upper and said chamber, said chamber inlet extending through said thickness of said midsole and said top wall of said chamber;

an inlet check valve disposed within said chamber inlet to permit fluid to flow into said chamber;

a chamber outlet for providing a fluid passageway between said chamber and said interior of said upper, said chamber outlet extending through said top wall of said chamber and said thickness of said midsole;

an outlet check valve disposed within said chamber outlet to permit fluid to flow out of said chamber; and an inflatable bladder disposed in the footwear for providing customized support to the foot of the wearer, said inflatable bladder having a bladder inlet disposed in fluid communication with said chamber outlet;

wherein movement of the foot by the wearer causes fluid to be continuously drawn into said chamber through said chamber inlet and expelled from said chamber through said chamber outlet to inflate said inflatable bladder.

2. The article of footwear of claim 1, wherein said inflatable bladder is disposed within said interior of said upper.

3. The article of footwear of claim 1, wherein said inflatable bladder further comprises a bladder outlet.

4. The article of footwear of claim 3 further comprising a regulator for maintaining a predetermined pressure within said inflatable bladder and wherein said regulator is in fluid communication with said bladder outlet.

5. The article of footwear of claim 4, wherein said inflatable bladder further comprises a release valve to release fluid from said inflatable bladder.

6. The article of footwear of claim 1, wherein said midsole is formed from a cushioning material and said outsole is formed from an abrasive resistant material.

7. The article of footwear of claim 1, wherein said midsole comprises a first recess located in a forefoot region of the article of footwear to define a forefoot chamber and a second recess located in a heel region of the article of footwear to define a heel chamber.

8. The article of footwear of claim 1, wherein said outsole comprises a first concavity located in a forefoot region of the article of footwear to define a forefoot chamber and a second concavity located in a heel region of the article of footwear to define a heel chamber.

9. An article of footwear, comprising:

an upper defining an interior for receiving a foot of a wearer; and a sole attached to said upper, said sole comprising:

a midsole having a top surface, a bottom surface, a first recess formed in said bottom surface of said midsole in a forefoot region of the article of footwear and a second recess formed in said bottom surface of said midsole in a heel region of the article of footwear;

an outsole having a top surface, a bottom surface, a first concavity formed in said top surface of said outsole in a forefoot region of the article of footwear and a second concavity formed in said top surface of said outsole in a heel region of the article of footwear, said midsole and said outsole being disposed in a facing relationship so that said first recess and said first concavity form a forefoot pumping chamber having a top wall and a bottom wall and said second recess and said second concavity form a heel pumping chamber having a top wall and a bottom wall;

a first chamber inlet for providing a fluid passageway between said interior of said upper and said forefoot pumping chamber, said first chamber inlet extending through said midsole and said top wall of said forefoot pumping chamber in a substantially vertical manner;

a second chamber inlet for providing a fluid passageway between said interior of said upper and said heel pumping chamber, said second chamber inlet extending through said midsole and said top wall of said heel pumping chamber in a substantially vertical manner;

a first inlet check valve disposed in said first chamber inlet for permitting fluid to flow into said forefoot pumping chamber;

a second inlet check valve disposed in said second chamber inlet for permitting fluid to flow into said heel pumping chamber;

a first chamber outlet for providing a fluid passageway between said forefoot pumping chamber and said interior of said upper, said first chamber outlet extending through said top wall of said forefoot pumping chamber and said midsole in a substantially vertical manner;

a second chamber outlet for providing a fluid passageway between said heel pumping chamber and said interior of said upper, said second chamber outlet extending through said top wall of said heel pumping chamber and said midsole in a substantially vertical manner;

a first outlet check valve disposed within said first chamber outlet for permitting fluid to flow out of said forefoot pumping chamber;

a second outlet check valve disposed within said second chamber outlet for permitting fluid to flow out of said heel pumping chamber; and an inflatable bladder for providing customized support to the foot of the wearer, said inflatable bladder having at least one bladder inlet disposed in fluid communication with one of said first chamber outlet or said second chamber outlet;

wherein movement of the foot of the wearer causes fluid to be drawn into said forefoot pumping chamber and said heel pumping chamber through said first chamber inlet and said second chamber inlet and expelled from said forefoot pumping chamber and said heel pumping chamber through said first chamber outlet and said second chamber outlet to inflate said inflatable ladder.

10. The article of footwear of claim 9, wherein said inflatable bladder is disposed within said interior of said upper.

11. The article of footwear of claim 9, wherein said inflatable bladder further comprises a bladder outlet.

12. The article of footwear of claim 11 further comprising a regulator for maintaining a predetermined pressure within said inflatable bladder and wherein said regulator is in fluid communication with said bladder outlet.

13. The article of footwear of claim 12, wherein said inflatable bladder further comprises a release valve to release fluid from said inflatable bladder.

14. The article of footwear of claim 9, wherein said midsole is formed from a cushioning material and said outsole is formed from an abrasive resistant material.

15. The article of footwear of claim 9, wherein said inflatable bladder further comprises a second bladder inlet disposed in fluid communication with the other of said first chamber outlet or said second chamber outlet.

16. The article of footwear of claim 9, wherein said first and second inlet check valves comprise a cylindrical housing having a valve ball.

17. The article of footwear of claim 9, wherein said first and second outlet check valves comprise an elastomeric tube having a duck-bill exit opening.

18. The article of footwear of claim 9, wherein said first concavity is approximately 3.5 mm deep.

19. The article of footwear of claim 9, wherein said second concavity is approximately 5.5 mm deep.

20. An article of footwear, comprising:

an upper defining an interior area for receiving a foot of a wearer;

a sole attached to said upper, said sole comprising a midsole having a thickness and an outsole having a thickness, said midsole and said outsole being joined to define a chamber for receiving a fluid, said chamber having a top wall and a bottom wall;

a chamber inlet for providing a fluid passageway between said interior area of said upper and said chamber, said chamber inlet extending from said interior area of said upper through said thickness of said midsole to said chamber in an area posterior to metatarsal heads of the wearer's foot and anterior to a calcaneus of the wearer's foot;

an inlet check valve disposed within said chamber inlet to permit fluid to flow into said chamber;

a chamber outlet for providing a fluid passageway between said chamber and said interior area of said upper, said chamber outlet extending from said chamber through said thickness of said midsole to said interior area of said upper in an area posterior to metatarsal heads of the wearer's foot and anterior to a calcaneus of the wearer's foot;

an outlet check valve disposed within said chamber outlet to permit fluid to flow out of said chamber; and an inflatable bladder for providing customized support to the foot of the wearer, said inflatable bladder having a bladder inlet disposed in fluid communication with said chamber outlet;

wherein movement of the foot by the wearer causes fluid to be continuously drawn into said chamber through said chamber inlet and expelled from said chamber through said chamber outlet to inflate said inflatable bladder.

* * * * *